US007177571B2

(12) United States Patent
Sato et al.

(10) Patent No.: US 7,177,571 B2
(45) Date of Patent: Feb. 13, 2007

(54) IMAGE FORMING APPARATUS USING A BELT-LIKE INTERMEDIATE TRANSFER MEMBER

(75) Inventors: Noribumi Sato, Saitama (JP); Tomoya Saeki, Saitama (JP); Masahiro Sato, Kanagawa (JP); Nobuhiro Hiroe, Saitama (JP); Keiji Sasaki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 310 days.

(21) Appl. No.: 10/879,143

(22) Filed: Jun. 30, 2004

(65) Prior Publication Data

US 2005/0141920 A1 Jun. 30, 2005

(30) Foreign Application Priority Data

Dec. 26, 2003 (JP) ..... P2003-435675

(51) Int. Cl.
*G03G 15/00* (2006.01)
*G03G 15/01* (2006.01)
*G03G 15/16* (2006.01)

(52) U.S. Cl. ..... 399/167; 399/298; 399/302

(58) Field of Classification Search ..... 399/101, 399/167, 297, 298, 301, 302
See application file for complete search history.

(56) References Cited

U.S. PATENT DOCUMENTS 6,336,024 B1 * 1/2002 Kanaya et al. ..... 399/301
6,766,124 B2 * 7/2004 Taguchi et al. ..... 399/302
6,985,681 B2 * 1/2006 Taguchi et al. ..... 399/302
6,990,298 B2 * 1/2006 Hamano et al. ..... 399/302

FOREIGN PATENT DOCUMENTS

| | | |
|---|---|---|
| JP | 2962088 | 8/1999 |
| JP | A-2000-298389 | 10/2000 |
| JP | A-2001-134040 | 5/2001 |
| JP | A-2002-278204 | 9/2002 |
| JP | A-2003-195712 | 7/2003 |

* cited by examiner

*Primary Examiner*—William J. Royer
(74) *Attorney, Agent, or Firm*—Morgan, Lewis & Bockius, LLP

(57) ABSTRACT

An image forming apparatus includes a photoreceptor, a driving unit which rotation-drives the photoreceptor, an exposure unit which forms a latent image by performing image exposure to the photoreceptor, a plurality of development units which develop a plurality of latent images sequentially formed on the photoreceptor with different color toners respectively, a belt-like intermediate transfer member onto which respective color toner images sequentially developed on the photoreceptor are primarily transferred to be superimposed on each other, at least one load unit which comes in contact with or is separated from the belt-like intermediate transfer member to change a load on the belt-like intermediate transfer member, and a speed control unit which increases/decreases a driving speed of the photoreceptor at a specified timing. Preferably, the belt-like intermediate transfer member is an elastic belt.

36 Claims, 14 Drawing Sheets

IMAGE FORMING APPARATUS USING A BELT-LIKE INTERMEDIATE TRANSFER MEMBER

FIELD OF THE INVENTION

The present invention relates to an image forming apparatus, such as a copying machine or a printer, to which an electrophotographic system is applied, and particularly to an image forming apparatus using a belt-like intermediate transfer member and capable of forming a full color image.

DESCRIPTION OF THE RELATED ART

Conventionally, as this kind of image forming apparatus, such as copying machines or printers, to which an electrophotographic system is applied, various types have been proposed and have been already commercially available. Among the image forming apparatuses, especially color image forming apparatuses forming full color images are roughly divided into a type that uses an intermediate transfer member and a type that does not use an intermediate transfer member. In the image forming apparatus using the intermediate transfer member, since a toner image formed on a photoreceptor is once primarily transferred onto an intermediate transfer member, the primary transfer can be performed irrespective of material of a recording medium, and the apparatus has a feature that it is advantageous in improving the image quality of a full color image.

Besides, the color image forming apparatuses using the intermediate transfer members are divided into a so-called "four-cycle system" and a so-called "tandem system". The "four-cycle system" color image forming apparatus is constructed such that toner images of respective colors of yellow, magenta, cyan, black and the like are sequentially formed on a single photoreceptor are primarily transferred onto an intermediate transfer member in a state where they are superimposed on each other, and then, the toner images of yellow, magenta, cyan, black and the like are transferred on the intermediate transfer member so as to be superimposed on each other are secondarily transferred onto a recording medium by a secondary roller, so that a color image is formed.

On the other hand, the "tandem system" color image forming apparatus is constructed such that toner images of respective colors of yellow, magenta, cyan, black and the like formed on plural (for example, four) photoreceptors are primarily transferred onto an intermediate transfer member in a state where they are superimposed on each other, and then, the toner images of yellow, magenta, cyan, black and the like are transferred on the intermediate transfer member so as to be superimposed on each other are secondarily transferred onto a recording medium by a secondary transfer roll, so that a color image is formed.

In the color image forming apparatus using the intermediate transfer member, in both cases of the four-cycle system and the tandem system, when the toner image formed on the photoreceptor is primarily transferred onto the intermediate transfer member, or when the toner image primarily transferred on the intermediate transfer member is secondarily transferred onto the recording medium, when variation occurs in the moving speed of the photoreceptor or the intermediate transfer member, a color shift occurs due to the variation in the speed of the photoreceptor or the intermediate transfer member. As the cause of the occurrence of the variation in the speed of the intermediate transfer member, it is possible to cite such an instance that a secondary transfer roll or a cleaning device comes in contact with or is separated from the intermediate transfer member, so that the load on the intermediate transfer member is changed.

As a technique to prevent the occurrence of the color shift due to the variation in the speed of the photoreceptor or the intermediate transfer member, one disclosed in, for example, Japanese Patent No. 2962088, JP-A-2000-298389, JP-A-2001-134040, JP-A-2002-278204, or JP-A-2003-195712 has already been proposed.

A color printer of Japanese Patent No. 2962088 includes a photoreceptor which is rotated by a photoreceptor driving unit, an exposure unit for forming a latent image by exposing the photoreceptor to a laser beam, a development unit for developing the latent image formed on the photoreceptor to have a color varying for each rotation and for forming a toner image, an intermediate transfer member to which toner images of different colors formed on the photoreceptor are transferred to be superimposed on each other, a transfer unit for transferring the images transferred on the intermediate transfer member to a recording medium, and a control unit for controlling the photoreceptor driving unit so that the photoreceptor is rotated at a target revolution speed, wherein the intermediate transfer member and the photoreceptor are disposed to be in contact with each other, the intermediate transfer member follows the photoreceptor and is rotated thereby, there are included a detection unit for detecting the passage of the intermediate transfer member through a specific position, and an intermediate transfer member rotation speed measuring unit for obtaining a rotation speed of the intermediate transfer member on the basis of the output of the detection unit, and on the basis of the measured intermediate transfer member rotation speed, the photoreceptor target rotation speed is changed when the latent image is not formed on the photoreceptor, so that a difference in the rotation speed for each rotation of the intermediate transfer member is suppressed, and the photoreceptor target rotation speed is kept constant when the latent image is formed on the photoreceptor.

An image forming apparatus of JP-A-2000-298389 is an image forming apparatus in which a photoreceptor and an intermediate transfer member are rotated by a drive source using a same driving signal so that multi-color images are superimposed on the intermediate transfer member, and a color image is formed, and which includes a position shift correction unit for correcting a transfer position shift, which occurs due to variation in the load on the intermediate transfer member at the time when each color image is transferred to the intermediate transfer member, by increasing/decreasing the rotation speed of the intermediate transfer member during a period when writing of the latent image to the photoreceptor is not performed.

An image forming apparatus of JP-A-2001-134040 includes a latent image supporting body, an exposure unit for exposing the latent image supporting body plural times correspondingly to images of respective color components of a color image, a development unit for toner developing latent images of the respective color components formed on the latent image supporting body, an intermediate transfer member on which a reference position mark indicating a reference position for decision of exposure start timing by the exposure unit is formed, a transfer unit for transferring toner images of the respective color components developed on the latent image supporting body to the intermediate transfer member so that their ends coincide with each other on the basis of the reference position, a detection unit for detecting a detection period of the reference position mark, and a control unit for obtaining a difference between the detection period of the reference position mark and a previously determined specific detection period and for performing a control to extend/shorten the exposure start timing of the same color component at the time of image formation of a next color image by a time corresponding to the error.

An image forming apparatus of JP-A-2002-278204 includes a rotating photoreceptor, a latent image writing unit for exposing the photoreceptor to light and writing a latent image, a development unit for developing the latent image with a specified color developer to form a toner image, an intermediate transfer member which is rotated to move in the same direction at a primary transfer position opposite to the photoreceptor, to which toner images of respective colors formed on the photoreceptor are primarily transferred so as to be superimposed on each other, and which transports the primarily transferred multiple toner images to a secondary transfer position where they are secondarily transferred at the same time, and a load part for periodically applying a load to the intermediate transfer member, wherein load variation to the intermediate transfer member caused by the load part occurs during the primary transfer, and the image forming apparatus includes a position shift correction unit for writing a latent image corresponding to a toner image portion, which is to be primarily transferred when the load variation to the intermediate transfer member occurs, in a state where it is shifted in a direction opposite to a direction of position shift of an image which can occur on the intermediate transfer member by the load variation.

An image forming apparatus of JP-A-2003-195712 includes an endless photoreceptor moved in a peripheral direction, an exposure unit for exposing the photoreceptor at an exposure position of the photoreceptor on the basis of image information to form a latent image on the photoreceptor, a development unit for developing a latent image with a developer at a downstream development position with respect to the exposure position of the exposure unit in a movement direction of the photoreceptor to form an image with the developer, an endless image supporting body moved in a peripheral direction while it comes in contact with the photoreceptor at a primary transfer position at a downstream side of the development position of the photoreceptor in the movement direction of the photoreceptor, a secondary transfer unit for transferring the image with the developer to a recording medium at a secondary transfer position at a downstream side with respect to the primary transfer position of the image supporting body in a movement direction of the image supporting body, a cleaning unit provided to be capable of coming in contact with and being separated from the image supporting body at a cleaning position at the downstream side of the secondary transfer position of the image supporting body in the image supporting body movement direction and at the upstream side of the primary transfer position, and for removing, by a contact operation, the developer remaining on the image supporting body after the secondary transfer of the secondary transfer unit, and a control unit for performing control so that the contact operation and a separating operation of the cleaning unit to the cleaning position are performed during a period when the exposure unit does not perform a latent image forming operation to the photoreceptor.

SUMMARY OF THE INVENTION

Problems that the Invention is to Solve

However, the above related arts have problems as follows. That is, in the case of the techniques disclosed in Japanese Patent No. 2962088, JP-A-2000-298389, JP-A-2001-134040, JP-A-2002-278204, and JP-A-2003-195712, during the period in which writing of the latent image to the photoreceptor is not performed, the rotation speed of the photoreceptor or the intermediate transfer member is changed, the contact and separation of the cleaning unit is performed, the control to extend and shorten the exposure start timing is performed in accordance with the difference between the detection period of the reference position mark and the previously determined specific detection period, or the writing position is corrected in the state where a shift is made in the direction opposite to the direction of the position shift of the image which can occur on the intermediate transfer member by the load variation.

However, the image forming apparatus as stated above has problems that in the case where the contact/separation operation of the cleaning unit or the secondary transfer roll to the surface of the intermediate transfer member occurs during the operation of forming or transferring the toner images of the respective colors of yellow, magenta, cyan, black and the like, the speed variation occurs in the intermediate transfer member, and there is a fear that the color shift occurs.

Besides, in the case where the contact/separation of the cleaning unit is performed while writing of the latent image to the photoreceptor is not performed, there has been a problem that the timing when the cleaning operation of the intermediate transfer member by the cleaning unit is ended becomes late, and the productivity of image formation per unit time must be reduced.

These problems become remarkable when an elastic belt having elasticity in the rotation direction of an intermediate transfer member is used as the intermediate transfer member.

The present invention has been made in view of the above circumstances and provides an image forming apparatus in which even in a case where a contact/separation operation of a cleaning unit or a secondary transfer member to the surface of an intermediate transfer member occurs during an image formation operation, the occurrence of a color shift can be prevented, and a high quality image can be formed without lowering productivity.

MEANS FOR SOLVING THE PROBLEMS

In order to solve the problems, according to an aspect of the invention, an image forming apparatus includes a photoreceptor, a driving unit which rotation-drives the photoreceptor, an exposure unit which forms a latent image by performing image exposure to the photoreceptor, plural development units which develop plural latent images sequentially formed on the photoreceptor with different color toners respectively, a belt-like intermediate transfer member onto which respective color toner images sequentially developed on the photoreceptor are primarily transferred to be superimposed on each other, at least one load unit which comes in contact with or is separated from the belt-like intermediate transfer member to change a load on the belt-like intermediate transfer member, and a speed control unit which increases/decreases a driving speed of the photoreceptor at a specified timing, and is characterized in that the belt-like intermediate transfer member is an elastic belt.

BRIEF DESCRIPTION OF THE DRAWINGS

Preferred embodiments of the present invention will be described in detail based on the following figures, wherein.

DETAILED DESCRIPTION OF THE INVENTION

Hereinafter, embodiments of this invention will be described with reference to the drawings.

Embodiment 1

Figure 1:
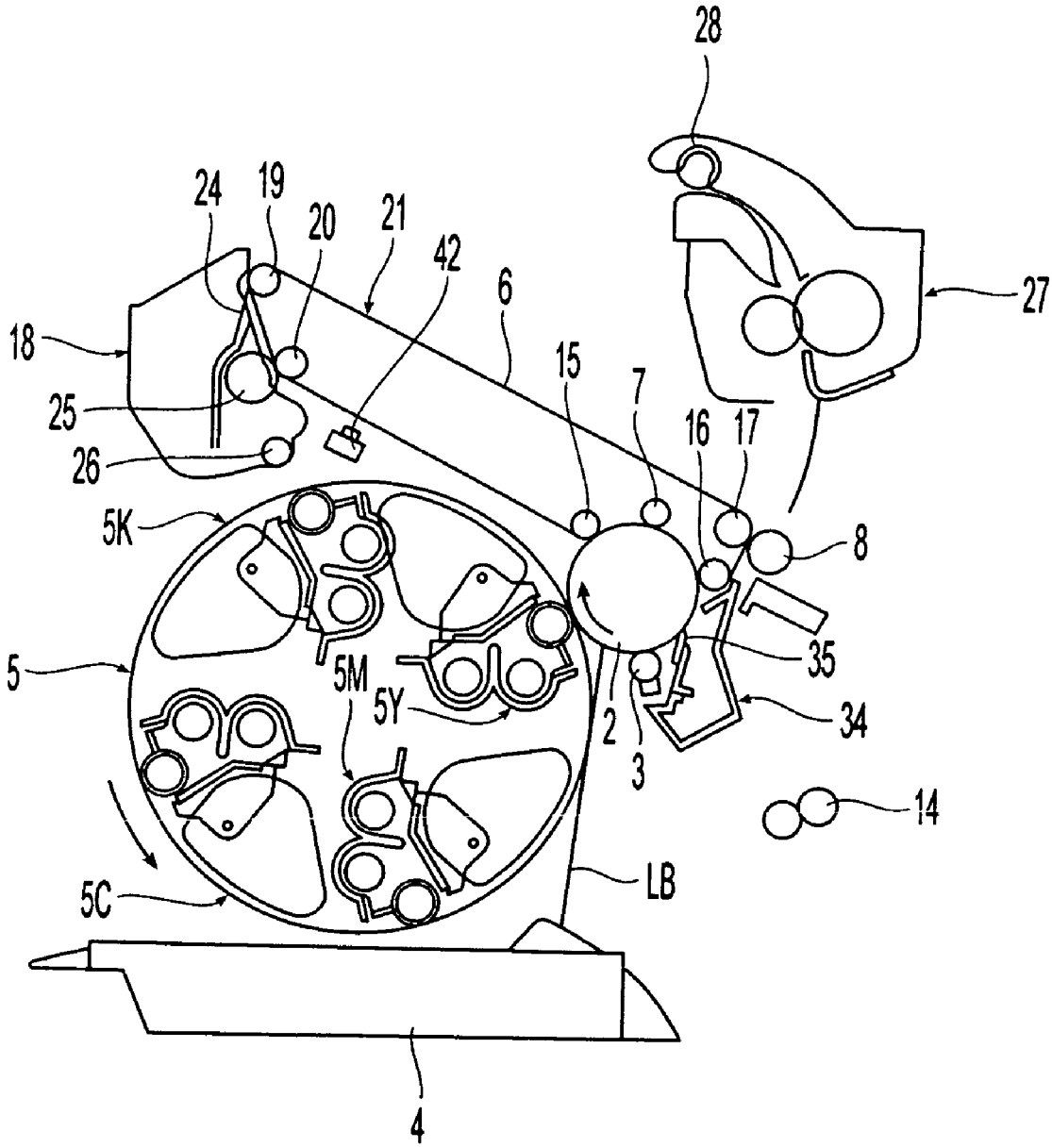
FIG. 1 is a structural view showing a main part of a full color printer as an image forming apparatus of embodiment 1 of this invention.
Figure 2:
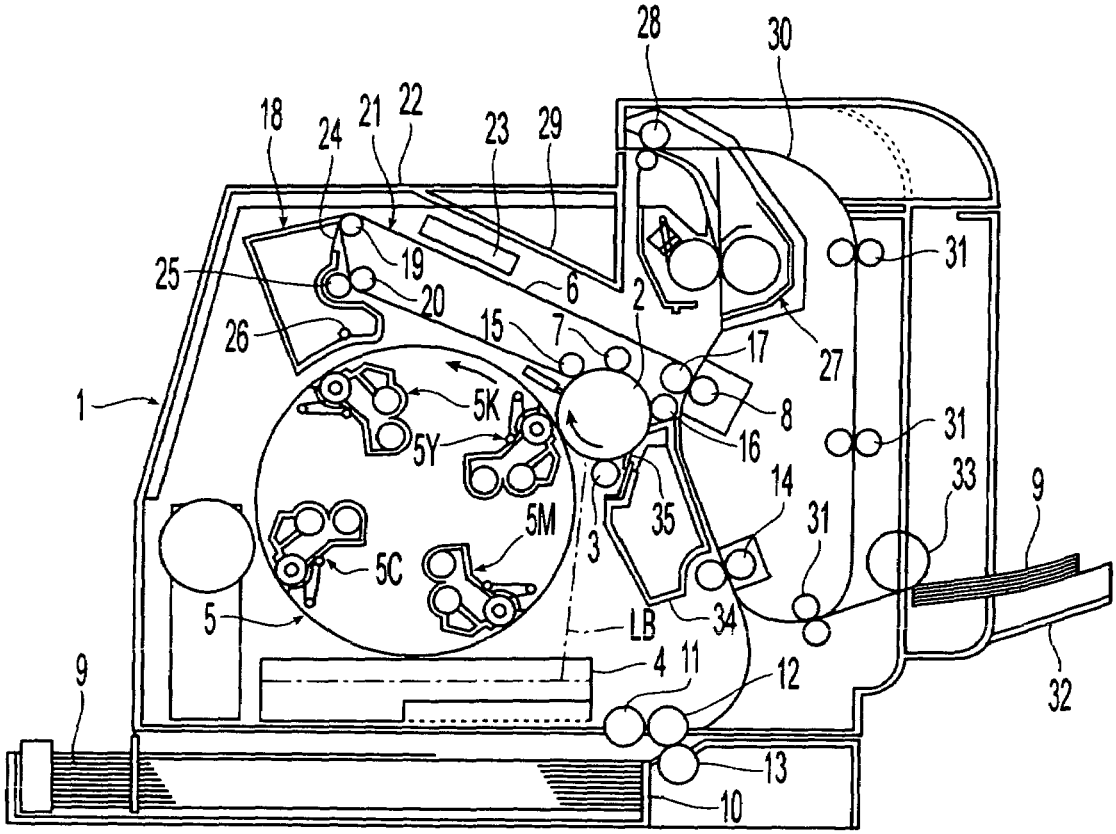
FIG. 2 is a structural view showing the full color printer as the image forming apparatus of embodiment 1 of this invention.

FIG. 1 is a structural view showing an image formation part of a four-cycle system full color printer as an image forming apparatus of embodiment 1 of this invention, and FIG. 2 is a whole structural view showing the four-cycle full color printer as the image forming apparatus of embodiment 1 of this invention.

In FIG. 2, reference numeral 1 denotes a main body of the full color printer, and a photosensitive drum 2 as an image supporting body is rotatably disposed in the inside of the full color printer main body 1 and at a slightly upper right part with respect to the center. As the photosensitive drum 2, for example, a conductive cylinder having a surface cover with a photosensitive layer made of OPC and having a diameter of about 47 mm is used, and is rotation driven by a not-shown driving unit at a process speed of about 150 mm/sec in an arrow direction. As shown in FIG. 1, after the surface of the photosensitive drum 2 is charged to a predetermined potential by a charging roll 3 as a charging unit disposed substantially just under the photosensitive drum 2, the surface is subjected to image exposure of a laser beam (LB) by a ROS 4 (Raster Output Scanner) as an exposure unit disposed at a separate position just under the photosensitive drum 2, and an electrostatic latent image corresponding to image information is formed. The electrostatic latent image formed on the photosensitive drum 2 is developed by a rotary development device 5 in which developer units 5Y, 5M, 5C and 5K of the respective colors of yellow (Y), magenta (M), cyan (C), and black (K) are disposed in the peripheral direction, and a toner image of a predetermined color is obtained.

At that time, on the surface of the photosensitive drum 2, according to the color of an image to be formed, the respective steps of charging, exposure, and development are repeated a predetermined number of times. The rotary development device 5 is rotation driven at a predetermined timing, and the developer unit 5Y, 5M, 5C or 5K corresponding to the color to be developed is moved to the development position opposite to the photosensitive drum 2. For example, in the case where a full color image is formed, the respective steps of charging, exposure and development are repeated on the surface of the photosensitive drum 2 four times correspondingly to the respective colors of yellow (Y), magenta (M), cyan (C) and black (K), and the toner images corresponding to the respective colors of yellow (Y), magenta (M), cyan (C) and black (K) are sequentially formed on the surface of the photosensitive drum 2. Although the number of times the photosensitive drum 2 rotates at the formation of the toner image varies according to the size of an image, when the size is, for example, A4, the image of one color is formed when the photosensitive drum 2 rotates three times. That is, each time the photosensitive drum 2 rotates three times, the toner image corresponding to each of the colors of yellow (Y), magenta (M), cyan (C), and black (K) is sequentially formed on the surface of the photosensitive drum 2. Incidentally, the respective toner images sequentially formed on the photosensitive drum 2 are primarily transferred onto an intermediate transfer belt 6 as described later in a state where they are superimposed on each other when passing through a primary transfer position.

The toner images of the respective colors of yellow (Y), magenta (M), cyan (C) and black (K) sequentially formed on the photosensitive drum 2 are primarily transferred onto the intermediate transfer member 6 by a primary transfer roll 7 at the primary transfer position where the intermediate transfer belt 6 as the intermediate transfer member is wound upon the outer periphery of the photosensitive drum 2 and in a state where they are superimposed on each other. The toner images of yellow (Y), magenta (M), cyan (C) and black (K) transferred on this intermediate transfer belt 6 in the superimposing manner are secondarily transferred at once by a secondary transfer roll or secondary transfer unit 8 onto a recording sheet or recording medium 9 fed at a predetermined timing. Although the secondary transfer roll 8 may be constructed to follow the intermediate transfer belt 6, it may be constructed to be rotation driven through a gear from a not-shown drive source. At that time, it is desirable that the secondary transfer roll 8 is rotation driven through a torque limiter so as to idle in a case where the rotation speed of the secondary transfer roll 8 becomes faster that the intermediate transfer belt 6, so that a difference in moving speed does not occur between them. As shown in FIG. 2, the recording sheet 9 is fed from a paper feed part 10 disposed at a lower part of the full color printer main body 1 by a pickup roll 11, and is fed in a state where the sheets are separated one by one by a feed roll 12 and a retard roll 13. The recording sheet 9 is put by a registration roll 14 into a state of synchronization with the toner image transferred on the intermediate transfer belt 6, and is transported to the secondary transfer position of the intermediate transfer belt 6. The secondary transfer roll 8 is constructed to come in contact with and to be separated from the surface of the intermediate transfer belt 6 at a predetermined timing. The secondary transfer roll 8 as the load unit is disposed at a position close to a downstream side of the photosensitive drum 2 with respect to a distance on the periphery of the intermediate transfer belt 6, and as described later, the driving speed of the photosensitive drum or photoreceptor 2 is decreased or increased in response to the timing when the load unit comes in contact with the intermediate transfer belt 6.

As shown in FIG. 1, the intermediate transfer belt 6 is stretched by plural rolls, and is constructed to follow the rotation of the photosensitive drum 2 so that a circular movement is performed at a predetermined process speed (about 150 mm/sec). As the intermediate transfer belt 6, one made of an elastic belt of chloroprene, urethane rubber, silicone rubber or the like and having elasticity is used in which Young's modulus of an elastic layer is 30 MPa or less. It is desirable that the elastic belt is made of chloroprene rubber in which Young's modulus is within a range of 5–15 MPa, urethane rubber in which Young's modulus is within a range of 5–30 MPa, or silicone rubber in which Young's modulus is within a range of 1.5–5 MPa. The intermediate transfer belt 6 is stretched under a predetermined tension at an upstream side of the photosensitive drum 2 in the rotation direction by a wrap in roll 15 for specifying a wrap position of the intermediate transfer belt 6, the primary transfer roll 7 for transferring a toner image formed on the photosensitive drum 2 onto the intermediate transfer belt 6, a wrap out roll 16 for specifying the wrap position of the intermediate transfer belt 6 at a downstream side of the wrap position, a backup roll 17 coming in contact with the secondary transfer roll 8 through the intermediate transfer belt 6, a first cleaning backup roll 19 opposite to a cleaning device or cleaning unit 18 of the intermediate transfer belt 6, and a second cleaning backup roll 20.

The intermediate transfer belt 6 is stretched by the plural rolls 7, 15 to 17, 19 and 20 as described above, and in this embodiment, in order to miniaturize the full color printer main body 1, its stretched sectional shape is made a flat, thin and long, and substantially trapezoidal.

Further, in this embodiment, as shown in FIG. 2, although the whole of the full color printer is miniaturized to the extent possible, the rotary development device 5 occupies a large space of the full color printer main body 1. Thus, the full color printer main body 1 is designed such that while miniaturization of the apparatus is achieved, the maintenance property of the intermediate transfer belt 6, the rotary development device 5 and the like is improved. Specifically, the intermediate transfer belt 6, together with the photosensitive drum 2, the charging roll 3, and the secondary transfer roll 8, constitutes an image forming unit 21, and the whole of the image forming unit 21 can be detached to and attached from the full color printer main body 1 by opening an upper cover 22 of the full color printer main body 1. A concentration sensor 23 made of a reflective photosensor for detecting a patch concentration of toner formed on the intermediate transfer belt 6 is disposed above the intermediate transfer belt 6.

The cleaning device 18 for the intermediate transfer belt 6 includes, as shown in FIG. 1, a scraper 24 disposed to come in contact with the surface of the intermediate transfer belt 6 stretched by the first cleaning backup roll 19, and a cleaning brush 25 disposed to come in press contact with the surface of the intermediate transfer belt 6 stretched by the second cleaning backup roll 20. The remaining toner and paper powder removed by the scraper 24 and the cleaning brush 25 is collected into the inside of the cleaning device 18. The cleaning device 18 is supported so that it can be swung in the counter clockwise direction in the drawing upon a swing shaft 26. The cleaning device 18 is retracted at a position separate from the surface of the intermediate transfer belt 6, and comes in contact with the surface of the intermediate transfer belt 6 at a predetermined timing. The cleaning device 18 as a load unit is disposed at a position close to an upstream side of the photosensitive drum 2 with respect to a distance on the periphery of the intermediate transfer belt 6, and as described later, the driving speed of the photosensitive drum 2 is increased or decreased in response to the timing when the load unit comes in contact with the intermediate transfer belt 6.

The secondary transfer roll 8 and the cleaning device 18 function as the load units which come in contact with the surface of the intermediate transfer belt 6 at the predetermined timing to give the load to the intermediate transfer belt 6. One of or both of the secondary transfer roll 8 and the cleaning device 18 come in contact with or are separated from the surface of the intermediate transfer belt 6, so that the load on the intermediate transfer belt 6 is changed.

Further, the recording sheet 9 onto which the toner images are transferred from the intermediate transfer belt 6 is transported to a fixing unit 27 as shown in FIG. 2, and the toner images are fixed on the recording sheet 9 by heat and pressure of the fixing unit 27. In the case of single-sided printing, the recording sheet 9 is exhausted by an exhaust roll 28 directly onto an exhaust tray 29 provided at an upper part of the printer main body 1.

On the other hand, in the case of double-sided printing, the recording sheet 9 on which the toner images were fixed by the fixing unit 27 is not exhausted directly to the exhaust tray 29 by the exhaust roll 28. In the state where the rear end of the recording sheet 9 is nipped by the exhaust roll 28, the exhaust roll 28 is reversely rotated, the transport passage of the recording sheet 9 is switched to a sheet transport passage 30 for double-sided printing, the recording sheet 9 in a state where the front and back of the recording sheet 9 are reversed is again transported to the secondary position of the intermediate transfer belt 6 by transport rolls 31 disposed in the sheet transport passage 30 for double-sided printing, and an image is formed on the back surface of the recording sheet 9.

Further, in the full color printer, as shown in FIG. 2, a manual tray 32 is openably/closably mounted to the side of the printer main body 1 optionally. A recording sheet 9 of an arbitrary size and kind put on the manual tray 32 is fed by a sheet feed roll 33, and is transported to the secondary transfer position of the intermediate transfer belt 6 through a transport roll 31 and the registration roll 14, so that an image can be formed on the recording sheet 9 of the arbitrary size and kind.

Incidentally, with respect to the surface of the photosensitive drum 2 after the transfer step of the toner image is ended, each time the photosensitive drum 2 is rotated once, the remaining toner or the like is removed by a cleaning blade 35 of a cleaning device 34 disposed at an obliquely lower part of the photosensitive drum 2, and preparation is made for a next image formation step.

In this embodiment, the image forming apparatus includes a photoreceptor, a driving unit which rotation-drives the photoreceptor, an exposure unit which forms a latent image by performing image exposure to the photoreceptor, plural development units which develop plural latent images sequentially formed on the photoreceptor with different color toners respectively, a belt-like intermediate transfer member which follows the photoreceptor and is driven thereby and onto which respective color toner images sequentially developed on the photoreceptor are primarily transferred to be superimposed on each other, and at least one load unit which comes in contact with or is separated from the belt-like intermediate transfer member to change a load on the belt-like intermediate transfer member, in which an elastic belt is used as the belt-like intermediate transfer member, and a speed control unit which increases/decreases a driving speed of the photoreceptor at a specified timing is provided.

Besides, in this embodiment, the speed control unit makes a photoreceptor driving speed in a part of or the whole of a period when a latent image of at least one color is formed different from a photoreceptor driving speed in latent image formation of another color.

Further, in this embodiment, during a period from start of latent image formation of a first color to completion of transfer of the first color, the speed control unit increases/decreases the driving speed of the photoreceptor in response to a timing when the load unit in contact with the belt-like intermediate transfer belt is separated therefrom.

Besides, in this embodiment, during a period from start of latent image formation of a final color to completion of transfer of the final color, the speed control unit increases/decreases the driving speed of the photoreceptor in response to a timing when the load unit separate from the belt-like intermediate transfer member comes in contact therewith.

Figure 3:
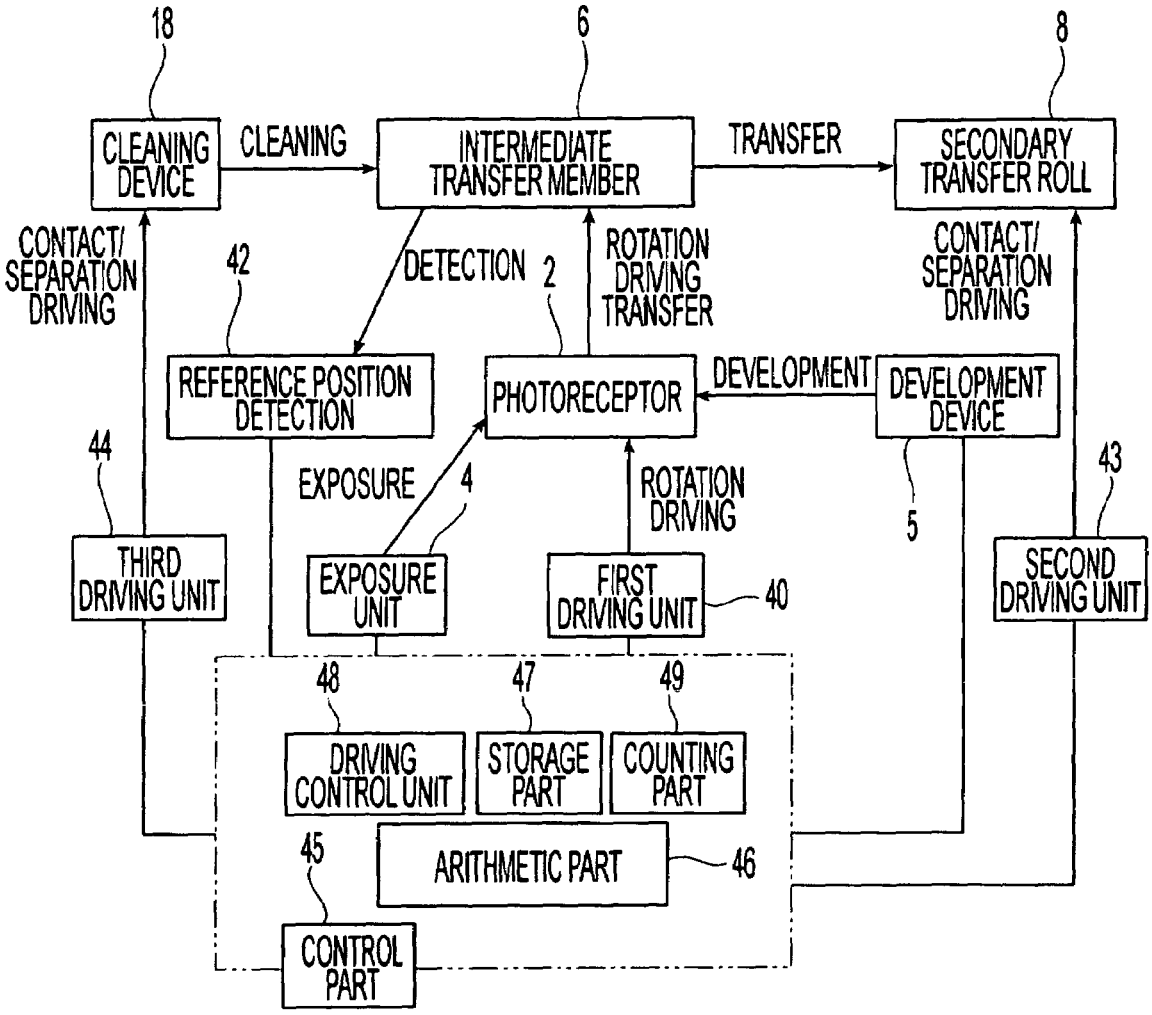
FIG. 3 is a block diagram showing a control part of the full color printer as the image forming apparatus of embodiment 1 of this invention.

FIG. 3 is a block diagram showing a control circuit of the full color printer of this embodiment together with the hardware configuration.

That is, the full color printer of this embodiment is constructed such that as shown in FIG. 3, the photosensitive drum or photoreceptor 2 is rotation driven at a predetermined peripheral speed (about 150 mm/sec) directly or through plural gears by a drive motor 40 made of a stepping motor or the like as a first driving unit. Besides, the intermediate transfer belt intermediate transfer member 6 is constructed to be driven and rotated by the photosensitive drum 2 in a state where it is wound upon the surface of the photosensitive drum 2.

Figure 4:
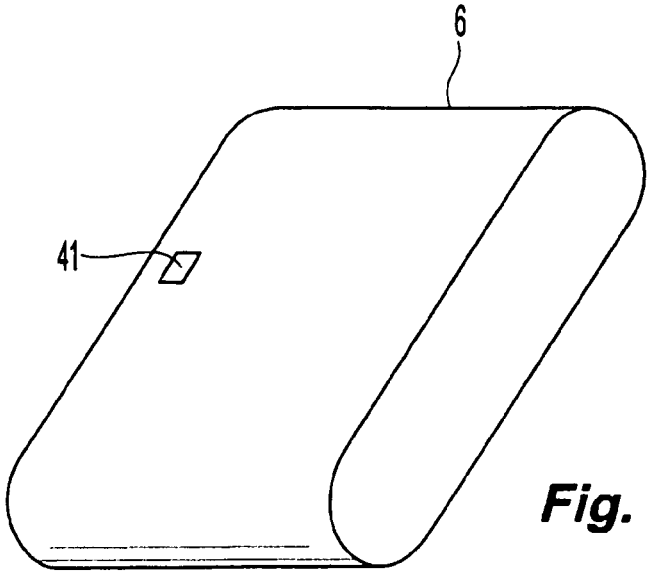
FIG. 4 is a perspective structural view showing a reference position mark provided on an intermediate transfer belt.

Besides, as shown in FIG. 4, a rectangular reference position mark 41 for detection of a rotation period of the intermediate transfer belt 6 is provided on the surface of the intermediate transfer belt 6 at one end in its width direction so as to reflect light by welding of synthetic resin and aluminum. As shown in FIG. 1, the reference position mark 41 is detected by a reference position detection unit 42 disposed in the vicinity of the lower surface of the intermediate transfer belt 6 along the circulation orbit of the intermediate transfer belt 6 and made of a reflective optical sensor.

Further, as shown in FIG. 3, the secondary transfer roll 8 is constructed to come in contact with or to be separated from the surface of the intermediate transfer belt 6 at a predetermined timing by an eccentric cam or the like driven by a second driving unit 43. Besides, the cleaning device 18 is constructed to come in contact with or to be separated from the surface of the intermediate transfer belt 6 at a predetermined timing by an eccentric cam or the like driven by a third driving unit 44.

Besides, a control part 45 also serving as a speed control unit of the full color printer includes, as shown in FIG. 3, an arithmetic part 46 made of a CPU and the like, a storage part 47 made of NVM and the like and for storing predetermined programs and parameters, a driving control unit 48 for controlling the first to third driving units 40, 43 and 44, and a counting part 49 made of a clock counter or the like and for counting a period in which the reference position mark 41 is detected by the reference position detection unit 42.

In the above configuration, in the full color printer of this embodiment, even in the case where the contact/separation operation of the cleaning device 18 or the secondary transfer roll 8 to the surface of the intermediate transfer belt 6 occurs during the operation of image formation, the occurrence of a color shift can be prevented, and a high quality image can be formed without lowering productivity.

That is, in the full color printer of this embodiment, the process control operation is carried out at a predetermined timing, and the control is performed so that the concentration of the toner image of each of the colors becomes equal to a predetermined concentration. This process control operation is carried out at the predetermined timing, for example, when the power supply of the printer is turned on, when a predetermined number of prints are obtained, when the number of revolutions of the photosensitive drum 2 reaches a predetermined value, or when the temperature or humidity of the inside of the printer main body 1 is changed by a predetermined value or higher. In the process control operation, patches of toner images of respective colors of yellow (Y), magenta (M), cyan (C) and black (K) are formed on the photosensitive drum 2 at a predetermined concentration such as 30% or 50%, the toner patches of the respective colors formed on the photosensitive drum 2 are read by the concentration sensor 23 as shown in FIG. 2 in a state where they are transferred on the intermediate transfer belt 6, and the controlling operation is performed to obtain predetermined image concentration by adjusting the toner concentration of the developer units 5Y, 5M, 5C and 5K, the development bias potential, the charging potential of the photosensitive drum 2, the exposure amount of the ROS 4 and the like by the arithmetic part 46.

At the time of the process control operation, an operation of measuring a period TR0 as a rotation period of the intermediate transfer belt 6 is performed simultaneously. Incidentally, the operation of measuring the period TR0 as the rotation period of the intermediate transfer belt 6 may be performed at a time other than the time of the process control operation. In the operation of measuring the rotation period of the intermediate transfer belt 6, as indicated at step ST101 of FIG. 5, first, the cleaning device 18 for the intermediate transfer belt 6 is separated, and in the state where the secondary transfer roll 8 is separated, the reference position mark 41 provided on the surface of the intermediate transfer belt 6 is detected by the reference position detection unit 42, and a cycle of obtaining the period of a TR0 signal as a pulse outputted from the reference position detection unit 42 is repeated for n cycles (for example, n=1), and a processing of obtaining an average value TR0_Ave of the TR0 period is performed. The average value TR0_Ave of the TR0 period corresponds to a rotation period TR0_MC of the intermediate transfer belt 6 at the time of the image formation operation of magenta and cyan in which image formation is performed in a state where the cleaning device 18 and the secondary transfer roll 8 are separated from the intermediate transfer belt 6. The value of n is normally set to 1 as described above, and in this case, the processing of obtaining the average value becomes unnecessary.

Figure 6:
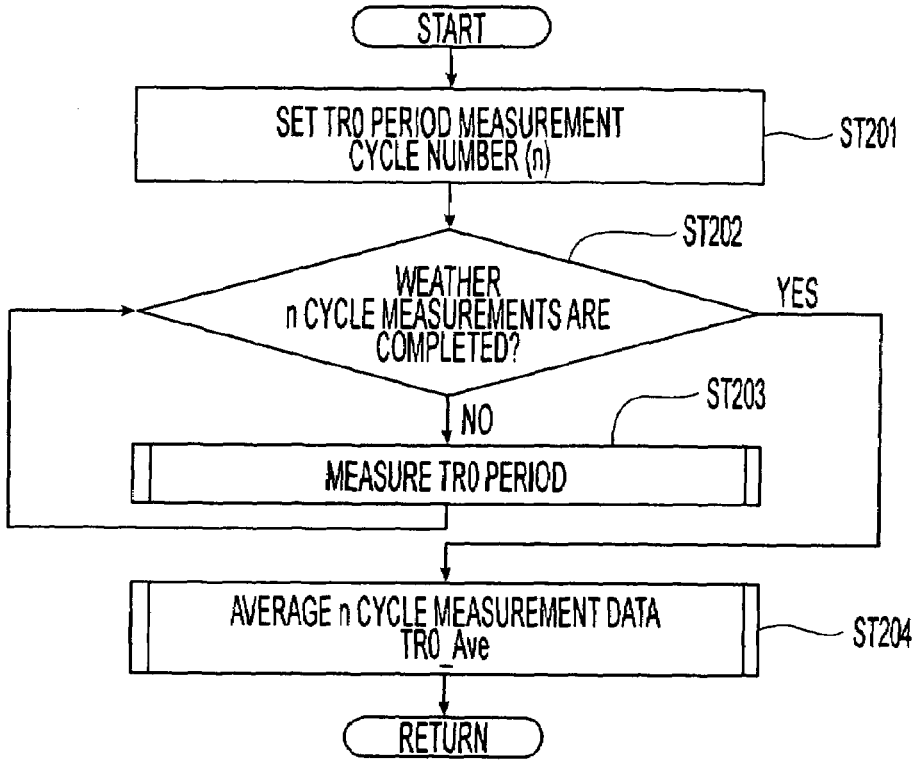
FIG. 6 is a flowchart showing the operation of the control part of the full color printer as the image forming apparatus of embodiment 1 of this invention.

With respect to the average value TR0_Ave of the TR0 period, as shown in FIG. 6, the value of n as the number of cycles for measuring the TR0 period is set by the control part 45 (step ST201), and it is judged whether or not the measurement of the set n cycles has completed (step ST202). In the case where it is judged that the measurement of the set n cycles has not been completed, the control part 45 performs the operation of measuring the period of TR0 (step ST203), and in the case where the measurement of the n cycles has been completed, the processing of calculating the average value TR0_Ave of the data measured for the n cycles is performed.

Figure 7:
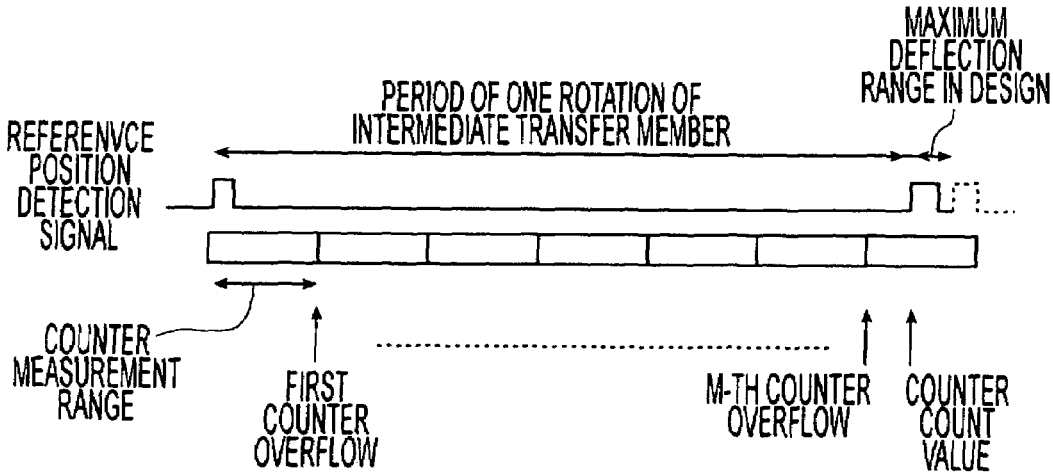
FIG. 7 is an explanatory view showing the operation of the control part of the full color printer as the image forming apparatus of embodiment 1 of this invention.

At that time, as shown in FIG. 7, the detection of the period of the TR0 signal outputted from the reference position detection unit 42 is performed by using a counter for counting a reference clock as the counting part 49 and by counting a time from a time point when the TR0 signal is outputted from the reference position detection unit 42 to a time point when a next TR0 signal is outputted. However, a time which can be measured by the counter as the counting part 49 is set to be shorter than the detected period of the TR0 signal. Thus, the counter continues counting while repeating an overflow, and is designed to measure a time from a time point when m overflows have occurred to a time point when the TR0 signal is detected. Since the number n of times the counter overflows can be previously grasped in design, it becomes possible to measure the period of the detection signal of the reference position mark 41 by adding a time, which is obtained by multiplying the measurement time from the start of measurement of the counter to the overflow by m, to the measurement time. Thus, in design, the counter has only to be capable of measuring a tolerance range of the detection period which can be previously grasped.

Figure 5:
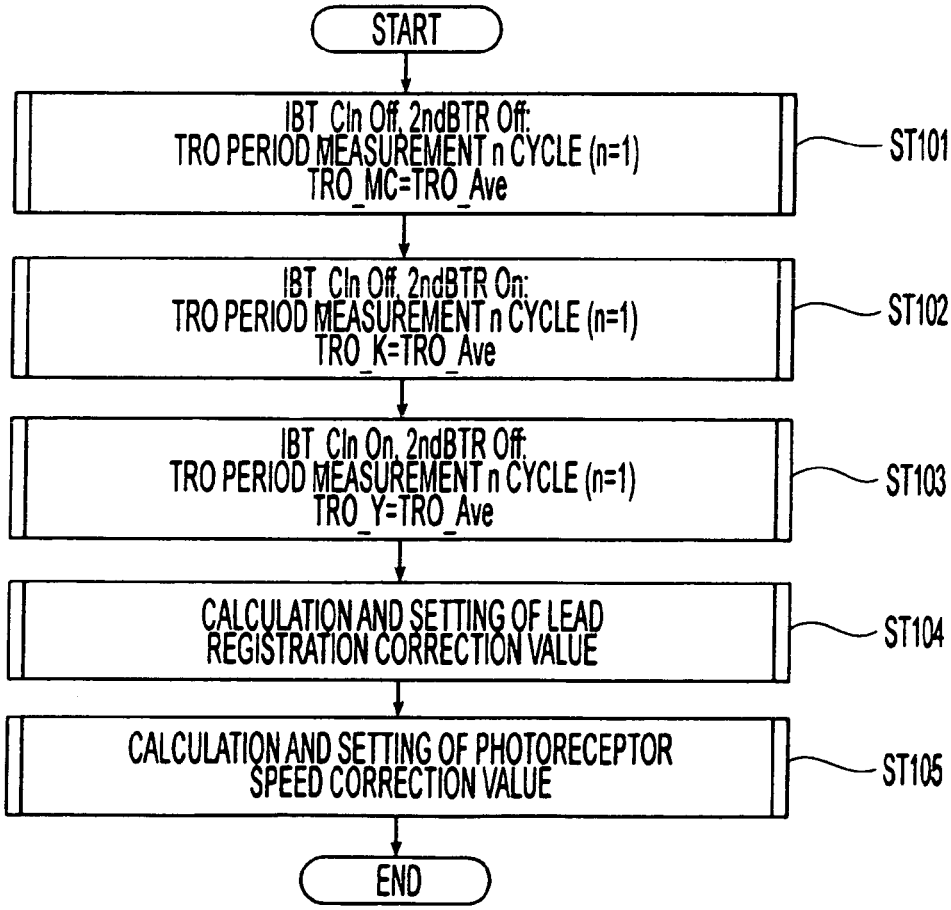
FIG. 5 is a flowchart showing the operation of the control part of the full color printer as the image forming apparatus of embodiment 1 of this invention.

Next, as indicated at step ST102 of FIG. 5, in the state where the cleaning device 18 is separated from the intermediate transfer belt 6 and the secondary transfer roll 8 is made to come in contact therewith, the control part 45 repeats measurement for n cycles (for example, n=1), and obtains the average value TR0_K of the TR0 period. The value TR0_K of the TR0 period corresponds to a black image formation operation in which image formation is performed in the state where the secondary transfer roll 8 is in contact with the intermediate transfer belt 6.

Thereafter, as indicated at step ST103 of FIG. 5, in the state where the cleaning device 18 is made to come in contact with the intermediate transfer belt 6, and the secondary transfer roll 8 is separated therefrom, the control part 45 repeats measurement for n cycles (for example, n=1), and obtains the average value TR0_Y of the TR0 period. The value TR0_Y of the TR0 period corresponds to the yellow image formation operation in which the image formation is performed in the state where the cleaning device 18 is in contact with the intermediate transfer belt 6.

On the basis of the measurement values TR0_MC, TR0_K and TR0_Y measured as described above, the control part 45 calculates and sets a correction value of lead registration as described below, and calculates and sets a correction value of the driving speed of the photosensitive drum 2 (step ST104, step ST105).

A correction value calculation processing of the driving speed of the photosensitive drum 2 is performed as follows.

The arithmetic part 46 of the control part 45 calculates PR_Vel_Y1A, PR_Vel_Y1B, PR_Vel_Y2A, PR_Vel_Y2B, PR_Vel_K1A and PR_Vel_K1B, which are photoreceptor speed auto mode correction values, on the basis of TR0_MC, TR0_K and TR0_Y, which are measurement values of the TR0 period, and PR_Vel_Coef_Y1A, PR_Vel_Coef_Y1B, PR_Vel_Coef_Y2A, PR_Vel_Coef_Y2B, PR_Vel_Coef_K1A and PR_Vel_Coef_K1B, which are photoreceptor speed correction calculation coefficients previously set in the storage part 47, and on the basis of following expressions:

$$PR_Vel_Y1A=(TR0_MC-TR0_Y)/PR_Vel_Coef_Y1A$$

$$PR_Vel_Y1B=(TR0_MC-TR0_Y)/PR_Vel_Coef_Y1B$$

$$PR_Vel_Y2A=(TR0_MC-TR0_Y)/PR_Vel_Coef_Y2A$$

$$PR_Vel_Y2B=(TR0_MC-TR0_Y)/PR_Vel_Coef_Y2B$$

$$PR_Vel_K1A=(TR0_MC-TR0_K)/PR_Vel_Coef_K1A$$

$$PR_Vel_K1B=(TR0_MC-TR0_K)/PR_Vel_Coef_K1B.$$

Besides, the arithmetic part 46 of the control part 45 calculates Lead_Reg_Y1, Lead_Reg_Y2 and Lead_Reg_K1, which are lead registration auto mode correction values, on the basis of TR0_MC, TR0_K and TR0_Y, which are measurement values of the TR0 period, and Lead_Reg_Coef_Y1, Lead_Reg_Coef_Y2 and Lead_Reg_Coef_K1, which are lead registration correction calculation coefficients previously set in the storage part 47, and on the basis of following expressions:

$$Lead_Reg_Y1=(TR0_Y-TR0_MC)\times Lead_Reg_Coef_Y1/1000$$

$$Lead_Reg_Y2=(TR0_Y-TR0_MC)\times Lead_Reg_Coef_Y2/1000$$

$$Lead_Reg_K1=(TR0_K-TR0_MC)\times Lead_Reg_Coef_K1/1000.$$

Next, in the full color printer of this embodiment, the printing operation of a color image is performed in a manner as described below.

In the full color printer, as shown in FIGS. 1 to 3, at the time of the printing operation, the photosensitive drum 2 is rotation driven by the drive motor 40 at a predetermined speed (about 150 mm/sec), and the intermediate transfer belt 6 follows the photosensitive drum 2 in a state where it is wound upon the surface of the photosensitive drum 2. At that time, during the period of the cycle up 1, as indicated at step ST301 of FIG. 8, the driving speed of yellow of the first color of the photosensitive drum 2, the correction value PR_Vel of the lead registration of image exposure to the surface of the photosensitive drum 2 and Lead_Reg are set by the control part 45.

Here, the correction value PR_Vel of the driving speed of yellow of the first color and the correction value Lead_Reg of lead registration of the image exposure to the surface of the photosensitive drum 2 are set as follows:

$$PR_Vel = PR_Vel_Y1A + PR_Vel_Y1AM$$

$$Lead_Reg = Lead_Reg_Y1 + Lead_Reg_Y1M.$$

Among the above correction values, PR_Vel_Y1AM and Lead_Reg_Y1M are manually separately set, and are set in the description of this embodiment as follows:

PR_Vel_Y1AM=0

Lead_Reg_Y1M=0.

Figure 9:
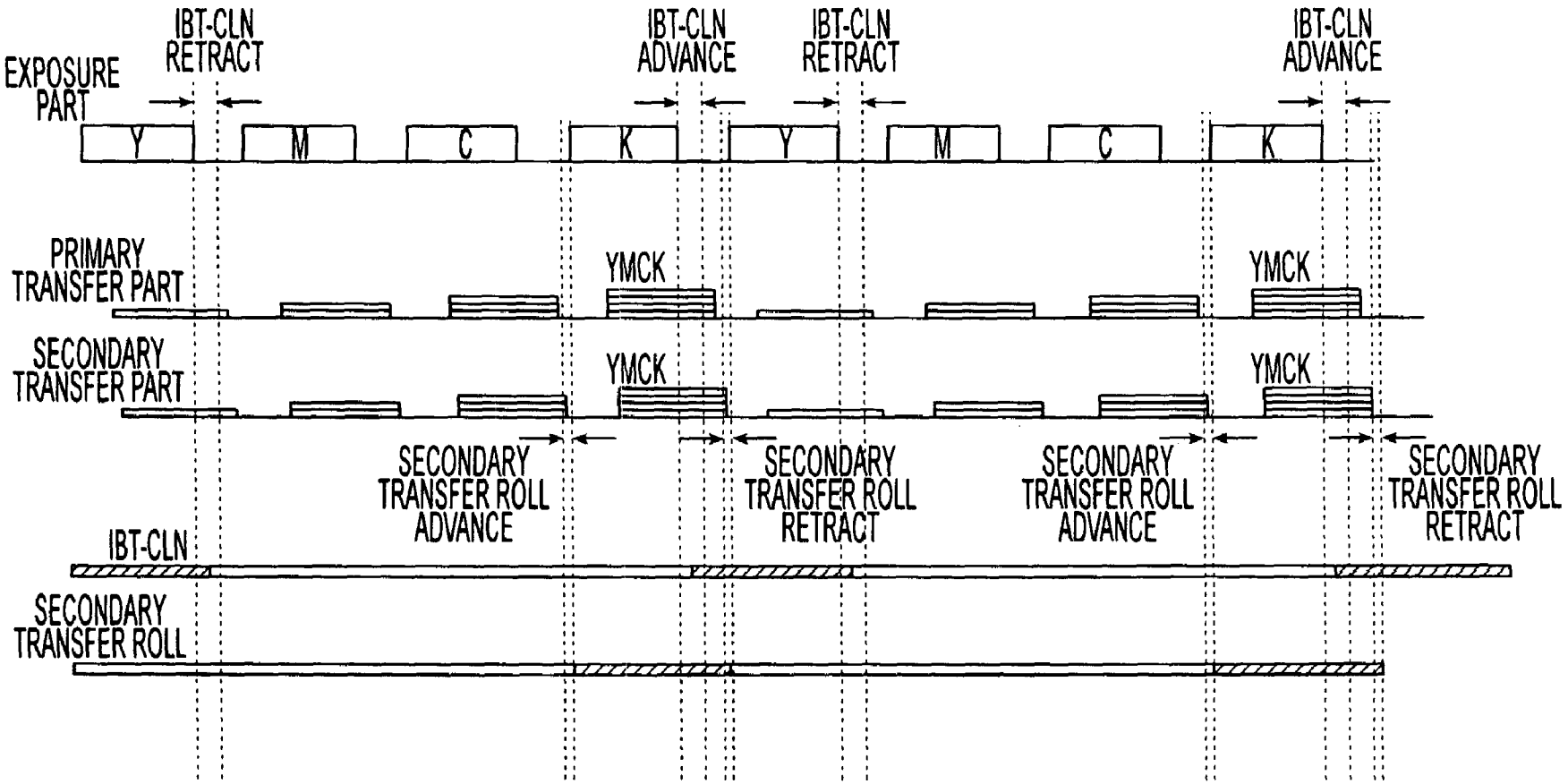
FIG. 9 is a timing chart showing the operation of the full color printer as the image forming apparatus of embodiment 1 of this invention.

Thereafter, as shown in FIG. 1, the surface of the photosensitive drum 2 is charged to a predetermined potential by the charging roll 3, and as shown in FIG. 9, image exposure corresponding to an image of yellow of the first color is carried out by the ROS 4, and an electrostatic latent image is formed. The electrostatic latent image formed on the photosensitive drum 2 is developed by the developer unit 5Y for yellow of the rotary development device 5, and an yellow toner image is formed on the surface of the photosensitive drum 2.

At that time, as shown in FIG. 9, the cleaning device 18 has been in contact with the surface of the intermediate transfer belt 6 since a time before the image exposure of yellow of the first color was performed to the surface of the photosensitive drum 2, and the surface of the intermediate transfer belt 6 has been cleaned by the cleaning device 18. That is, the image exposure of yellow of the first color to the surface of the photosensitive drum 2 is performed in the state where the cleaning device 18 is in contact with the surface of the intermediate transfer belt 6 wound upon the surface of the photosensitive drum 2 and driven thereby.

Figure 10:
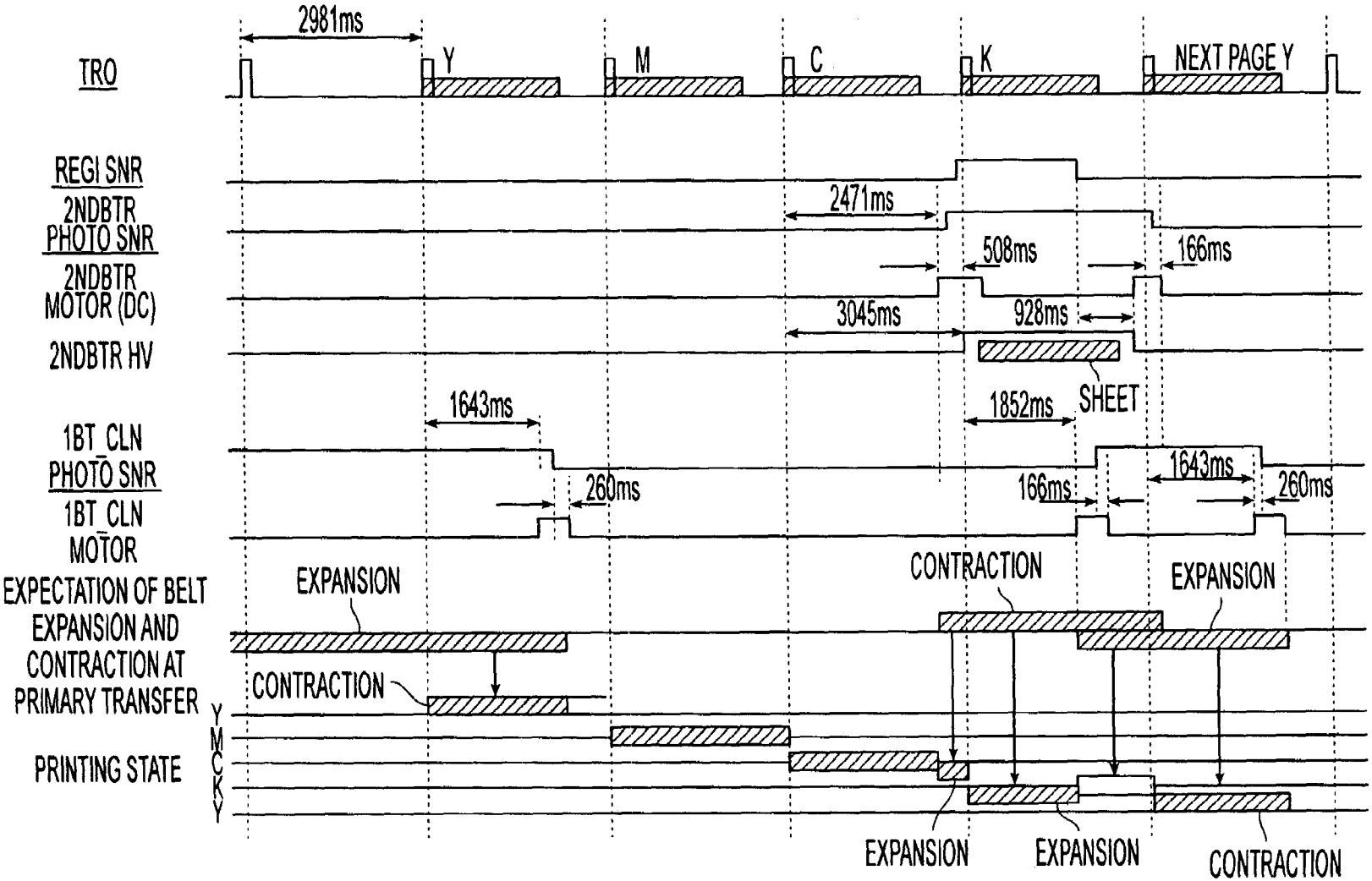
FIG. 10 is a timing chart showing the operation of the full color printer as the image forming apparatus of embodiment 1 of this invention.

In the state where the cleaning device 18 is in contact with the surface of the intermediate transfer belt 6, since the cleaning device 18 is in contact with the intermediate transfer belt 6, which follows the photosensitive drum 2 and is driven thereby, at the upstream side of the wound position to the photosensitive drum 2, there occurs a state where a load is applied to the intermediate transfer belt 6. Since the intermediate transfer belt 6 is made of the elastic belt, when the load is applied to the intermediate transfer belt 6, as shown in FIG. 10, the intermediate transfer belt 6 is put in an expanded state, and the image exposure and development of yellow of the first color is performed in the state where the intermediate transfer belt 6 is expanded. As a result, when the cleaning device 18 is separated from the intermediate transfer belt 6 after the image exposure of yellow, the intermediate transfer belt 6 is put in a contracted state, and therefore, as shown in FIG. 10, the yellow toner image transferred on the intermediate transfer belt 6 has been transferred onto the intermediate transfer belt 6 in the contracted state.

Figure 8:
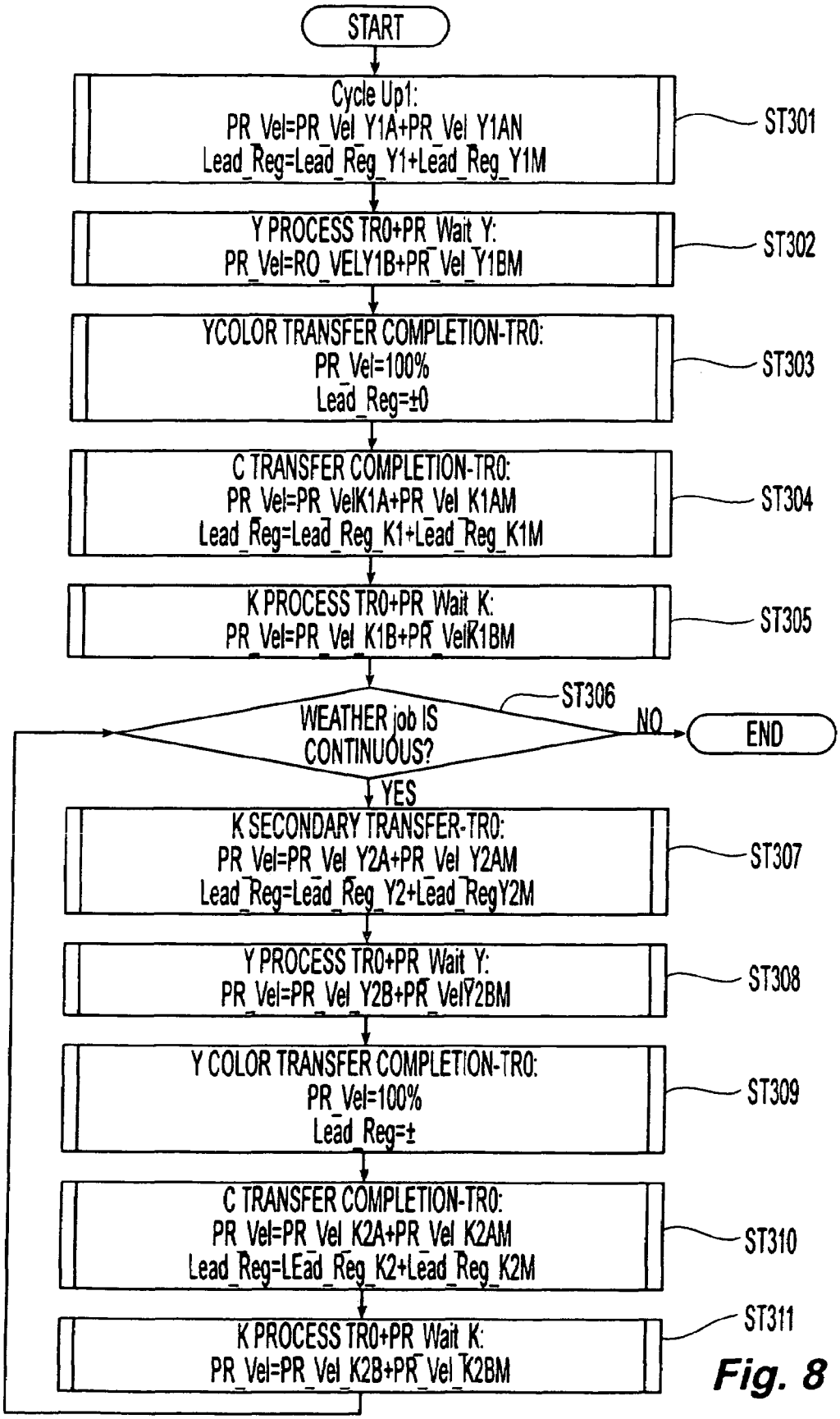
FIG. 8 is a flowchart showing the operation of the control part of the full color printer as the image forming apparatus of embodiment 1 of this invention.

Thus, in the full color printer, as shown in FIG. 8, at the time of the image formation of yellow of the first color, the driving speed of the photosensitive drum 2 and the lead registration of the image exposure to the surface of the photosensitive drum 2 are controlled in accordance with the correction value PR_Vel and the correction value Lead_Reg, so that the driving speed of the photosensitive drum 2 becomes slow by a predetermined value obtained by the measurement value of TR0, and the lead registration of the image exposure to the surface of the photosensitive drum 2 becomes fast by a predetermined value obtained by the measurement value of TR0.

Next, when the yellow image exposure to the surface of the photosensitive drum 2 is ended, as shown in FIG. 9, the cleaning device 18 is separated from the surface of the intermediate transfer belt 6. At this time, the yellow toner image formed on the surface of the photosensitive drum 2 is in the state where it has been primarily transferred on the intermediate transfer belt 6 at the primary transfer position as shown in FIG. 9. Thus, when the cleaning device 18 is separated at the predetermined timing, the load is decreased by that, and the intermediate transfer belt 6 is put in the contracted state.

Then, after a predetermined time PR_Wait_Y has elapsed since TR0 was detected, that is, at the timing when the cleaning device 18 is separated from the intermediate transfer belt 6, the control part 45 changes, as indicated at step ST302 of FIG. 8, the speed correction value of the photosensitive drum 2 for yellow to a next value again:

$$PR_Vel = PR_Vel_Y1B + PR_Vel_Y1BM.$$

Incidentally, among the above correction values, PR_Vel_Y1BM is manually separately set, and is set to 0 in the description of this embodiment.

Here, in the state where the cleaning device 18 is separated from the surface of the intermediate transfer belt 6, there occurs the state in which the load of the cleaning device 18 is not applied to the intermediate transfer belt 6, and therefore, the intermediate transfer belt 6 is put in the original state where it contracts.

Thereafter, after the surface of the photosensitive drum 2 is charged to a predetermined potential by the charging roll 3, as shown in FIG. 9, image exposure corresponding to an image of, for example, magenta of the second color is performed by the ROS 4, and an electrostatic latent image is formed. The electrostatic latent image formed on the photosensitive drum 2 is developed by the developer unit 5M for magenta of the rotary development device 5, and a magenta toner image is formed on the surface of the photosensitive drum 2. As shown in FIG. 9, the magenta toner image formed on the surface of the photosensitive drum 2 is primarily transferred in a superimposed state at the primary transfer position onto the intermediate transfer belt 6 on which the yellow toner image has already been transferred.

As shown in FIG. 1, since the image exposure and development of magenta are performed in the state where both the cleaning device 18 and the secondary transfer roll 8 are separate from the surface of the intermediate transfer belt 6, as indicated at step ST303 of FIG. 8, the correction value PR_Vel of the driving speed of the photosensitive drum 2 is set to 100% during a period from a time point when the primary transfer of the yellow toner image is completed to a time point when a next TR0 is detected, and the correction value Lead_Reg of the lead registration of the image exposure to the surface of the photosensitive drum 2 is set to □0.

Next, after the surface of the photosensitive drum 2 is charged to a predetermined potential by the charging roll 3, as shown in FIG. 9, image exposure corresponding to an image of cyan of the third color is performed by the ROS 4, and an electrostatic latent image is formed. The electrostatic latent image formed on the photosensitive drum 2 is developed by the developer unit 5C for cyan of the rotary development device 5, and a cyan toner image is formed on the surface of the photosensitive drum 2. As shown in FIG. 9, the cyan toner image formed on the surface of the photosensitive drum 2 is primarily transferred in a superimposed state at the primary transfer position onto the intermediate transfer belt 6 on which the yellow and magenta toner images have already been transferred.

Incidentally, as shown in FIG. 1, since the image exposure and development of cyan are also performed in the state where both the cleaning device 18 and the secondary transfer roll 8 are separate from the surface of the intermediate transfer belt 6, the correction value PR_Vel of the driving speed of the photosensitive drum 2 is set to 100%, and the correction value Lead_Reg of the lead registration of the image exposure to the surface of the photosensitive drum 2 remains set to □0.

Further, after the surface of the photosensitive drum 2 is charged to a predetermined potential by the charging roll 3, as shown in FIG. 9, image exposure corresponding to an image of black of the fourth color is performed by the ROS 4, and an electrostatic latent image is formed. The electrostatic latent image formed on the photosensitive drum 2 is developed by the developer unit 5K for black of the rotary development device 5, and a black toner image is formed on the surface of the photosensitive drum 2. As shown in FIG. 9, the black toner image formed on the surface of the photosensitive drum 2 is primarily transferred in a superimposed state at the primary transfer position onto the intermediate transfer belt 6 on which the yellow, magenta and cyan toner images have already been transferred.

At that time, as shown in FIG. 9, before the black image exposure is performed, the secondary transfer roll 8 comes in contact with the surface of the intermediate transfer belt 6. Although the intermediate transfer belt 6 is driven and rotated in the state where it is wound upon the surface of the photosensitive drum 2, as the load at the time when the secondary transfer roll 8 comes in contact with the surface of the intermediate transfer belt 6 is increased, the intermediate transfer belt 6 is put in the contracted state as shown in FIG. 10. When the black image exposure to the photosensitive drum 2 is ended, the cleaning apparatus 18 comes in contact with the surface of the intermediate transfer belt 6. At this time, the load to the intermediate transfer belt 6 is increased by the cleaning device 18, and the intermediate transfer belt 6 is driven and rotated in the state where it is wound upon the surface of the photosensitive drum 2, and it is considered that the black toner image primarily transferred from the photosensitive drum 2 to the intermediate transfer belt 6 is put in the state where the contraction and expansion are compensated with each other.

As indicated at step ST304 of FIG. 8, at a timing during a period from a time point when the primary transfer of the cyan toner image is ended to a time point when a next TR0 is detected, the control part 45 sets the correction value PR_Vel of the driving speed of the photosensitive drum 2 for black and the correction value Lead_Reg of the lead registration of the image exposure to the surface of the photosensitive drum 2 as follows:

$$PR_Vel = PR_Vel_K1A + PR_Vel_K1AM$$

$$\text{Lead}_Reg = \text{Lead}_Reg_K1 + \text{Lead}_Reg_K1M.$$

Among the above correction values, PR_Vel_K1AM and Lead_Reg_K1M are manually separately set, and are set in the description of this embodiment as follows:

$$\text{PR_Vel_K1AM} = 0$$

$$\text{Lead_Reg_K1M} = 0.$$

As stated above, as shown in FIG. 9, the secondary transfer roll 8 has been in contact with the surface of the intermediate transfer belt 6 since a time before the image exposure of black of the final color was performed to the surface of the photosensitive drum 2. That is, the image exposure of black of the final color to the surface of the photosensitive drum 2 is performed in the state where the secondary transfer roll 8 remains in contact with the surface of the intermediate transfer belt 6 wound upon the surface of the photosensitive drum 2 and driven thereby.

In the state where the secondary transfer roll 8 is in contact with the surface of the intermediate transfer belt 6, the secondary transfer roll 8 is in contact with the intermediate transfer belt 6, which follows the photosensitive drum 2 and is driven thereby, at a downstream side of the wound position to the photosensitive drum 2 and at a position very close thereto. Thus, the intermediate transfer belt 6 sent out by the rotation of the photosensitive drum 2 is in a state where a brake as a load is applied by the secondary transfer roll 8. Since the intermediate transfer belt 6 is made of the elastic belt, when the load is applied to the intermediate transfer belt 6 at the downstream side, as shown in FIG. 10, the intermediate transfer belt 6 is put in the contracted state, and the image exposure and development of black of the final color are performed in the state where the intermediate transfer belt 6 is contracted. As a result, since the black toner image formed on the photosensitive drum 2 is primarily transferred onto the intermediate transfer belt 6 in the contracted state, as shown in FIG. 10, eventually, the black toner image is put in the expanded state with respect to the magenta and cyan toner images.

Thus, in the full color printer, as indicated at step ST304 of FIG. 8, at the time of the black image formation, the driving speed of the photosensitive drum 2 and the lead registration of the image exposure to the surface of the photosensitive drum 2 are controlled in accordance with the correction value PR_Vel and the correction value Lead_Reg so that the driving speed of the photosensitive drum 2 becomes fast by a predetermined value obtained by the measurement value of TR0, and the lead registration of the image exposure to the surface of the photosensitive drum 2 becomes late by a predetermined value obtained by the measurement value of TR0.

Besides, as shown in FIG. 9, when the black image exposure to the surface of the photosensitive drum 2 is ended, the cleaning device 18 comes in contact with the surface of the intermediate transfer belt 6, and accordingly, there occurs a state in which the load on the intermediate transfer belt 6 is increased. Thus, the intermediate transfer belt 6 is put in a contracted state in which both the contraction action of the secondary transfer roll 8 and the expansion action of the cleaning device 18 are simultaneously applied.

Then, after a predetermined time PR_Wait_K has passed since the black TR0 was detected, that is, at the timing when the cleaning device 18 comes in contact with the intermediate transfer belt 6, the control part 45 changes the speed correction value of the photosensitive drum 2 for black to a next value again as indicated at step ST305 of FIG. 8:

$$PR_Vel = PR_Vel_K1B + PR_Vel_K1BM.$$

Among the correction values, PR_Vel_K1BM is manually separately set, and is set to 0 in the description of this embodiment.

Next, as indicated at step ST306 of FIG. 8, the control part 45 judges whether or not a job is continuous, and in the case where the job is not continuous, the image formation operation is ended. In the case where it is judged that the job is continuous, during a period from a time point when the secondary transfer of the black toner image is completed to a next TR0, as indicated at step ST307 of FIG. 8, the control part 45 sets the correction values PR_Vel and Lead_Reg of the driving speed of the photosensitive drum 2 for yellow of a second sheet and the lead registration of the image exposure to the surface of the photosensitive drum 2.

Here, the correction value PR_Vel of the driving speed for yellow of the second sheet and the correction value Lead_Reg of the lead registration of the image exposure to the surface of the photosensitive drum 2 are set as follows:

$$PR_Vel=PR_Vel_Y2A+PR_Vel_Y2AM$$

$$Lead_Reg=Lead_Reg_Y2+Lead_Reg_Y2M.$$

Among the above correction values, PR_Vel_Y2AM and Lead_Reg_Y2M are manually separately set, and are set in the description of this embodiment as follows:

PR_Vel_Y2AM=0

Lead_Reg_YeM=0.

Thereafter, similarly to the first sheet, after the surface of the photosensitive drum 2 is charged to a predetermined potential by the charging roll 3, as shown in FIG. 9, image exposure corresponding to an image of yellow of the first color is performed by the ROS 4, and an electrostatic latent image is formed. The electrostatic latent image formed on the photosensitive drum 2 is developed by the developer unit 5Y for yellow of the rotary development device 5, and an yellow toner image is formed on the surface of the photosensitive drum 2.

At that time, as shown in FIG. 9, the cleaning device 18 has been in contact with the surface of the intermediate transfer belt 6 since a time before the image exposure of yellow of the first color was performed to the surface of the photosensitive drum 2, and the surface of the intermediate transfer belt 6 has been cleaned by the cleaning device 18. That is, the image exposure of yellow of the first color to the surface of the photosensitive drum 2 is performed in the state where the cleaning device 18 remains in contact with the surface of the intermediate transfer belt 6 which is wound upon the surface of the photosensitive drum 2 and is driven thereby.

Next, when the yellow image exposure to the surface of the photosensitive drum 2 is ended, as shown in FIG. 9, the cleaning device 18 is separated from the surface of the intermediate transfer belt 6. At this time, as shown in FIG. 9, the yellow toner image formed on the surface of the photosensitive drum 2 is in a state where it has been primarily transferred onto the intermediate transfer belt 6 at the primary transfer position. Thus, when the cleaning device 18 is separated at a predetermined timing, the load is reduced by that, and accordingly, the intermediate transfer belt 6 is put in the contracted state.

Then, after a predetermined time PR_Wait_Y has passed since TR0 was detected, that is, at the timing when the cleaning device 18 is separated from the intermediate transfer belt 6, the control part 45 changes the speed correction value of the photosensitive drum 2 for yellow to a next value again as indicated at step ST308 of FIG. 8:

$$PR_Vel=PR_Vel_Y2B+PR_Vel_Y2BM.$$

Among the above correction values, PR_Vel_Y2BM is manually separately set, and is set to 0 in the description of this embodiment.

Thereafter, after the surface of the photosensitive drum 2 is charged to a predetermined potential by the charging roll 3, as shown in FIG. 9, image exposure corresponding to, for example, an image of magenta of the second color is performed by the ROS 4, and an electrostatic latent image is formed. The electrostatic latent image formed on the photosensitive drum 2 is developed by the developer unit 5M for magenta of the rotary development device 5, and a magenta toner image is formed on the surface of the photosensitive drum 2. The magenta toner image formed on the surface of the photosensitive drum 2 is, as shown in FIG. 9, primarily transferred at the primary transfer position in a superimposed state onto the intermediate transfer belt 6 on which the yellow toner image has already been transferred.

Incidentally, as shown in FIG. 1, since the magenta image exposure and development are performed in the state where both the cleaning device 18 and the secondary transfer roll 8 are separated from the surface of the intermediate transfer belt 6, during a period from a time point when the primary transfer of the yellow toner image is completed to a time point when next TR0 is detected, as indicated at step ST309 of FIG. 8, the correction value PR_Vel of the driving speed of the photosensitive drum 2 is set to 100%, and the correction value Lead_Reg of the lead registration of the image exposure to the surface of the photosensitive drum 2 is set to +0.

Next, after the surface of the photosensitive drum 2 is charged to a predetermined potential by the charging roll 3, as shown in FIG. 9, image exposure corresponding to an image of cyan of the third color is performed by the ROS 4, and an electrostatic latent image is formed. The electrostatic latent image formed on the photosensitive drum 2 is developed by the developer unit 5C for cyan of the rotary development device 5, and a cyan toner image is formed on the surface of the photosensitive drum 2. As shown in FIG. 9, the cyan toner image formed on the surface of the photosensitive drum 2 is primarily transferred at the primary transfer position in a superimposed state onto the intermediate transfer belt 6 on which the yellow and magenta toner images have already transferred.

Incidentally, as shown in FIG. 1, the cyan image exposure and development are also performed in the state where both the cleaning device 18 and the secondary transfer roll 8 are separate from the surface of the intermediate transfer belt 6, the correction value PR_Vel of the driving speed of the photosensitive drum 2 is set to 100%, and the correction value Lead_Reg of the lead registration of the image exposure to the surface of the photosensitive drum 2 remains set to □0.

Further, after the surface of the photosensitive drum 2 is charged to a predetermined potential by the charging roll 3, as shown in FIG. 9, image exposure corresponding to an image of black of the fourth color is performed by the ROS 4, and an electrostatic latent image is formed. The electrostatic latent image formed on the photosensitive drum 2 is developed by the developer unit 5*k* for black of the rotary development device 5, and a black toner image is formed on the surface of the photosensitive drum 2. As shown in FIG. 9, the black toner image formed on the surface of the photosensitive drum 2 is primarily transferred at the primary transfer position in a superimposed state onto the intermediate transfer belt 6 on which the yellow, magenta and cyan toner images have already been transferred.

At that time, as shown in FIG. 9, the secondary transfer roll 8 comes in contact with the surface of the intermediate transfer belt 6 before the black image exposure is performed. Although the intermediate transfer belt 6 is in the state where it is wound upon the surface of the photosensitive drum 2 and is driven thereby, as the load at the time when the secondary transfer roll 8 comes in contact with the surface of the intermediate transfer belt 6 is increased, the intermediate transfer belt 6 is put in the contracted state as shown in FIG. 10. When the black image exposure to the photosensitive drum 2 is ended, the cleaning device 18 comes in contact with the surface of the intermediate transfer belt 6. At this time, the load to the intermediate transfer belt 6 is increased by the cleaning device 18, and the intermediate transfer belt 6 is in the state where it is wound upon the surface of the photosensitive drum 2 and is driven thereby. Accordingly, it is considered that the black toner image primarily transferred from the photosensitive drum 2 to the intermediate transfer belt 6 is put in the state where contraction and extension are compensated with each other.

Then, as indicated at step ST310 of FIG. 8, at a timing during a period from a time point when the primary transfer of the cyan toner image is ended to a time point when a next TR0 is detected, the control part 45 sets the correction value PR_Vel of the driving speed of the photosensitive drum 2 for black and the correction value Lead_Reg of the lead registration of the image exposure to the surface of the photosensitive drum 2 as follows:

$$PR_Vel = PR_Vel_K2A + PR_Vel_K2AM$$

$$\text{Lead}_Reg = \text{Lead}_Reg_K2 + \text{Lead}_Reg_K2M.$$

Among the above correction values, PR_Vel_K2AM and Lead_Reg_K2M are manually separately set, and are set in the description of this embodiment as follows:

$$\text{PR_Vel_K2AM} = 0$$

$$\text{Lead_Reg_K2M} = 0.$$

As stated above, as shown in FIG. 9, the second transfer roll 8 has been in contact with the surface of the intermediate transfer belt 6 since a time before the image exposure of black of the final color was performed to the surface of the photosensitive drum 2. That is, the image exposure of black of the final color to the surface of the photosensitive drum 2 is performed in the state where the secondary transfer roll 8 remains in contact with the surface of the intermediate transfer belt 6 which is wound upon the surface of the photosensitive drum 2 and is driven thereby.

Besides, as shown in FIG. 9, when the black image exposure to the surface of the photosensitive drum 2 is ended, the cleaning device 18 comes in contact with the surface of the intermediate transfer belt 6, and accordingly, the load to the intermediate transfer belt 6 is increased. Thus, there occurs a contracted state in which both the contracting action by the secondary transfer roll 8 and the expanding action by the cleaning device 18 are applied to the intermediate transfer belt 6 at the same time.

After a predetermined time PR_Wait_K has passed since black TR0 was detected, that is, at the timing when the cleaning device 18 comes in contact with the intermediate transfer belt 6, the control part 45 changes the speed correction value of the photosensitive drum 2 for black again to a next value as indicated at step ST311 of FIG. 8:

$$PR_Vel = PR_Vel_K2B + PR_Vel_K2BM.$$

Among the above correction values, PR_Vel_K2BM is manually separately set, and is set to 0 in the description of this embodiment.

As stated above, in this embodiment, in the image forming step of forming the toner images of the respective colors of yellow (Y), magenta (M), cyan (C) and black (K) on the photosensitive drum 2, or when the toner images of the respective colors of yellow (Y), magenta (M), cyan (C) and black (K) formed on the photosensitive drum 2 are primarily transferred onto the intermediate transfer belt 6, or when the plural color toner images are secondarily transferred onto the recording sheet 9 at once from the intermediate transfer belt 6, the cleaning device 18 or the secondary transfer roll 8 comes in contact with or is separated from the intermediate transfer belt 6, so that the load to the intermediate transfer belt 6 is changed.

Figure 11A:
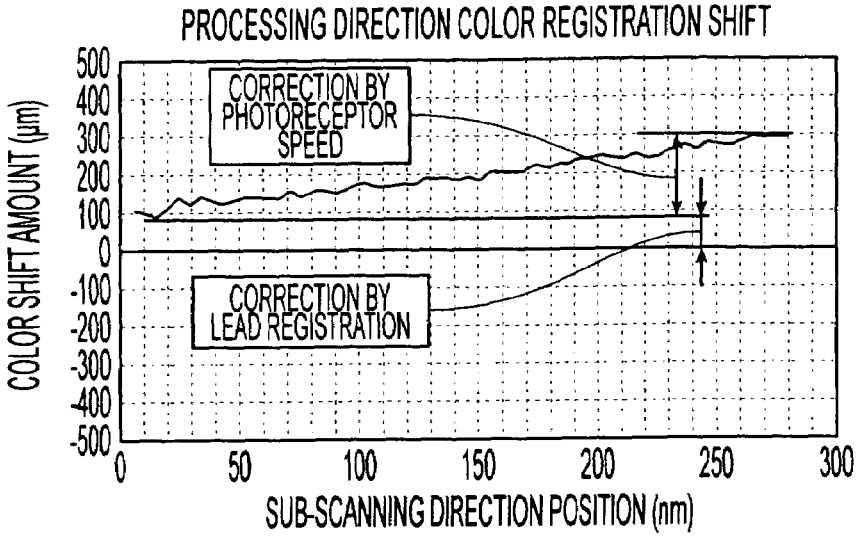
FIGS. 11A to 11C are explanatory views showing the operation of the full color printer as the image forming apparatus of embodiment 1 of this invention.

Thus, in the full color printer, when any correction control is not performed, due to the expansion and contraction of the intermediate transfer belt 6 caused by the change of the load on the intermediate transfer belt 6, as shown in FIG. 11A, the shift of the toner images of yellow (Y), magenta (M) and black (K) with reference to the cyan toner image become large toward the rear end of the recording sheet 9.

Figure 11B:
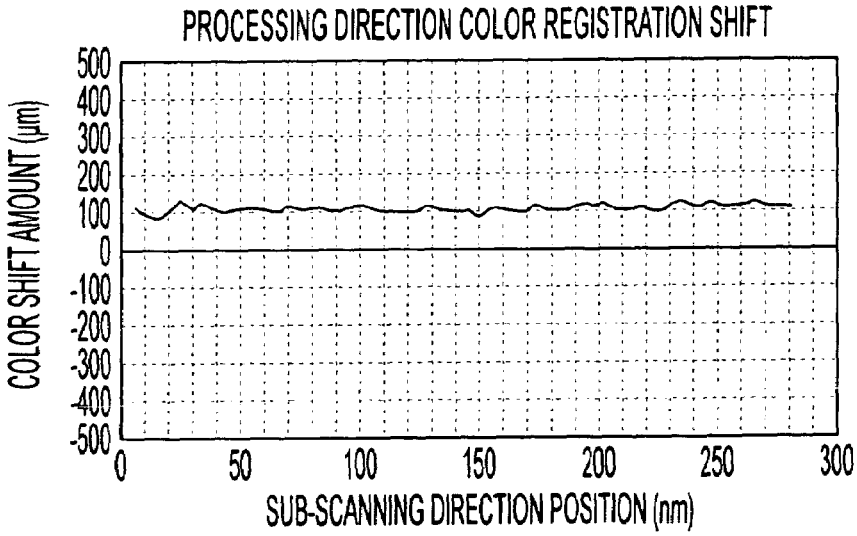

In the full color printer of this embodiment, as shown in FIG. 8, the driving speed of the photosensitive drum 2 is controlled at the predetermined timing, so that the shift of the image due to the change of the load on the intermediate transfer belt 6 is corrected, and as shown in FIG. 11B, the shift amounts of the yellow (Y), magenta (M) and black (K) toner images with reference to the cyan toner image can be made substantially constant over the whole length of the recording sheet 9.

Figure 11C:
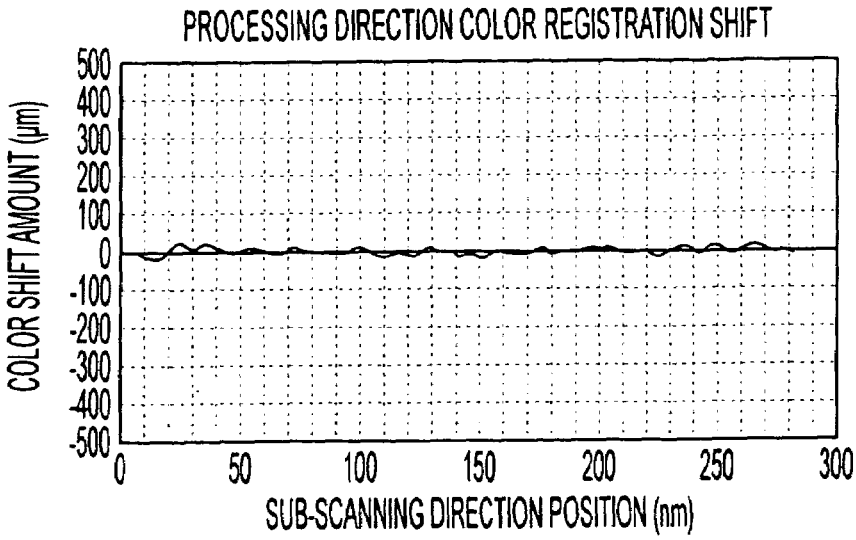

As a result, in the full color printer, as shown in FIG. 8, the shift amount of the lead registration to the photosensitive drum 2 is also corrected, so that as shown in FIG. 11C, the shift amounts of the yellow (Y), magenta (M) and black (K) toner images with reference to the cyan toner image can be greatly reduced over the whole length of the recording sheet 9, and a high quality color image can be formed.

Accordingly, in the full color printer, even in the case where the cleaning device 18 or the secondary transfer roll 8 performs the operation of coming in contact with or separating from the surface of the intermediate transfer belt 6 during the image formation operation, it is possible to prevent the color shift from occurring, and it is possible to form a high quality image without lowering productivity.

Embodiment 2

Figure 12:
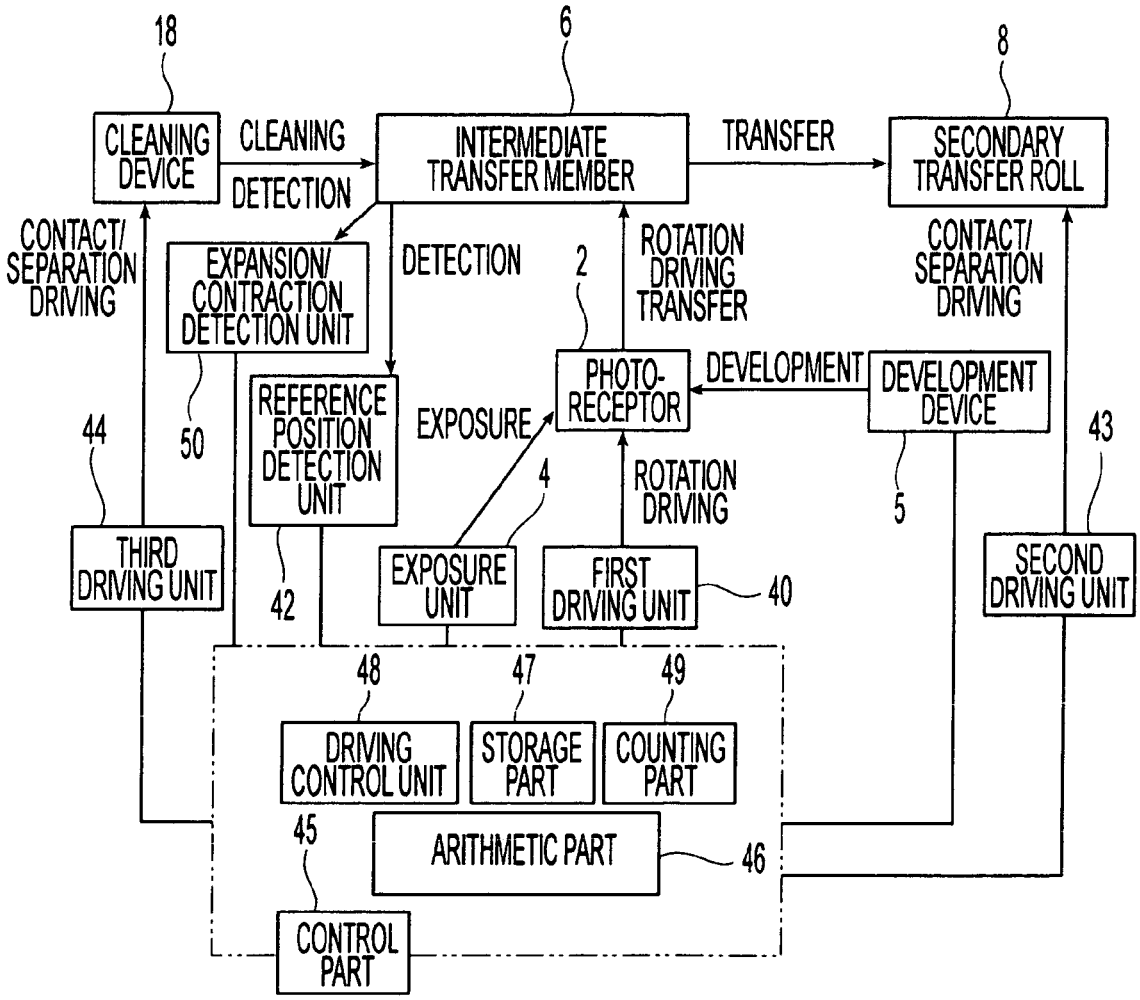
FIG. 12 is a block diagram showing a control part of a full color printer as an image forming apparatus of embodiment 2 of this invention.

FIG. 12 shows embodiment 2 of this invention, and the same portions as those of the embodiment 1 are denoted by the same reference numerals in the following description. This embodiment includes an expansion/contraction detection unit 50 for detecting the expansion and contraction of a belt-like intermediate transfer member 6, and this expansion/contraction detection unit 50 is provided separately from a reference position detection unit 42.

As the expansion/contraction detection unit 50, it is possible to use a unit for detecting a load applied to a roll for stretching the intermediate transfer member 6 by a W-sensor, a unit for directly detecting the expansion of the intermediate transfer member 6 by a distortion gauge, or a unit for reading marks provided on the intermediate transfer member 6 at equal intervals and for calculating its detection period.

Since the other structure and operation are the same as those of the embodiment 1, their description will be omitted.

Embodiment 3

Figure 13:
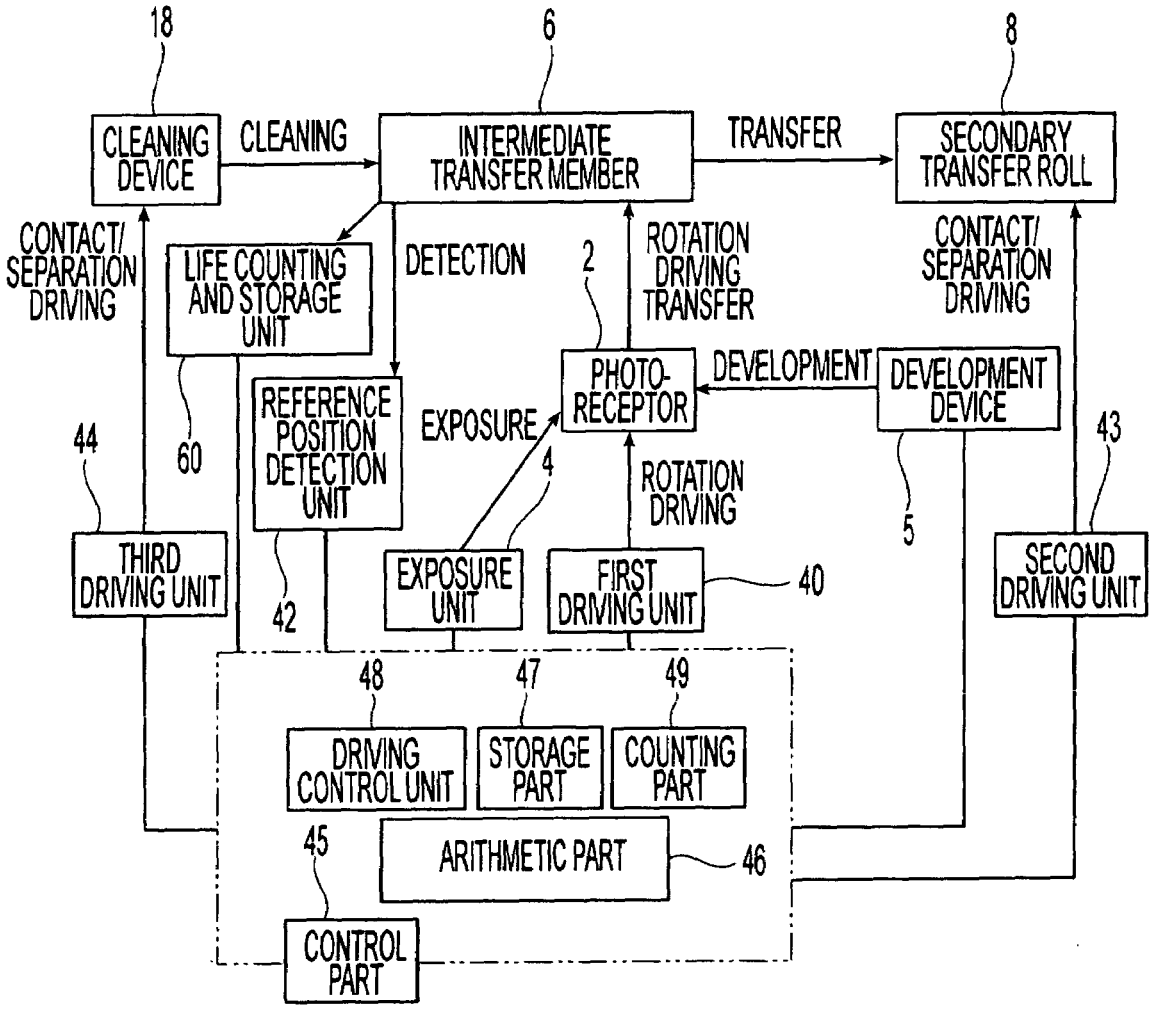
FIG. 13 is a block diagram showing a control part of a full color printer as an image forming apparatus of embodiment 3 of this invention.

FIG. 13 shows embodiment 3 of this invention, and the same portions as those of the embodiment 1 are denoted by the same reference numerals in the following description. This embodiment 3 includes a life counting and storage unit 60 for counting and storing the life of a photoreceptor 2 and/or a belt-like intermediate transfer member 6, and when the driving speed of the photoreceptor 2 is increased/decreased, an increase/decrease value at the time when the driving speed of the photoreceptor 2 is increased/decreased is corrected on the basis of the life information stored in the life counting and storage unit 60.

That is, in this embodiment 3, as shown in FIG. 13, there is provided a life counting and storage unit 60 for counting and storing the life of a photoreceptor 2 and/or a belt-like intermediate transfer member 6. This life counting and storage unit 60 is constructed integrally with the photoreceptor 2 and/or the belt-like intermediate transfer member 6. A storage unit for storing the number of revolutions of a photoreceptor 2 and an intermediate transfer member 6 and the number of prints is attached to an image formation unit 21 in which the photoreceptor 2 and the intermediate transfer member 6 are mounted, and the life of the photoreceptor 2 and/or the belt-like intermediate transfer member 6 can be read by performing communication with a printer body side.

With respect to the intermediate transfer member 6, it is naturally expected that its physical properties, for example, its size at the time of no load, and elastic coefficient are changed due to aging till the end of its life. The changes of the physical properties with the passage of time are previously grasped by experiment and measurement, and the driving speed of the photoreceptor 2 is corrected on the basis of the result and the life information of the intermediate transfer member 6 and/or the photoreceptor 2 stored in the life counting and storage unit 60, so that the image superimposition shift correction on the intermediate transfer member 6 can be performed with high accuracy.

Since the other structure and operation are the same as those of the embodiment 1, their description will be omitted.

Embodiment 4

Figure 14:
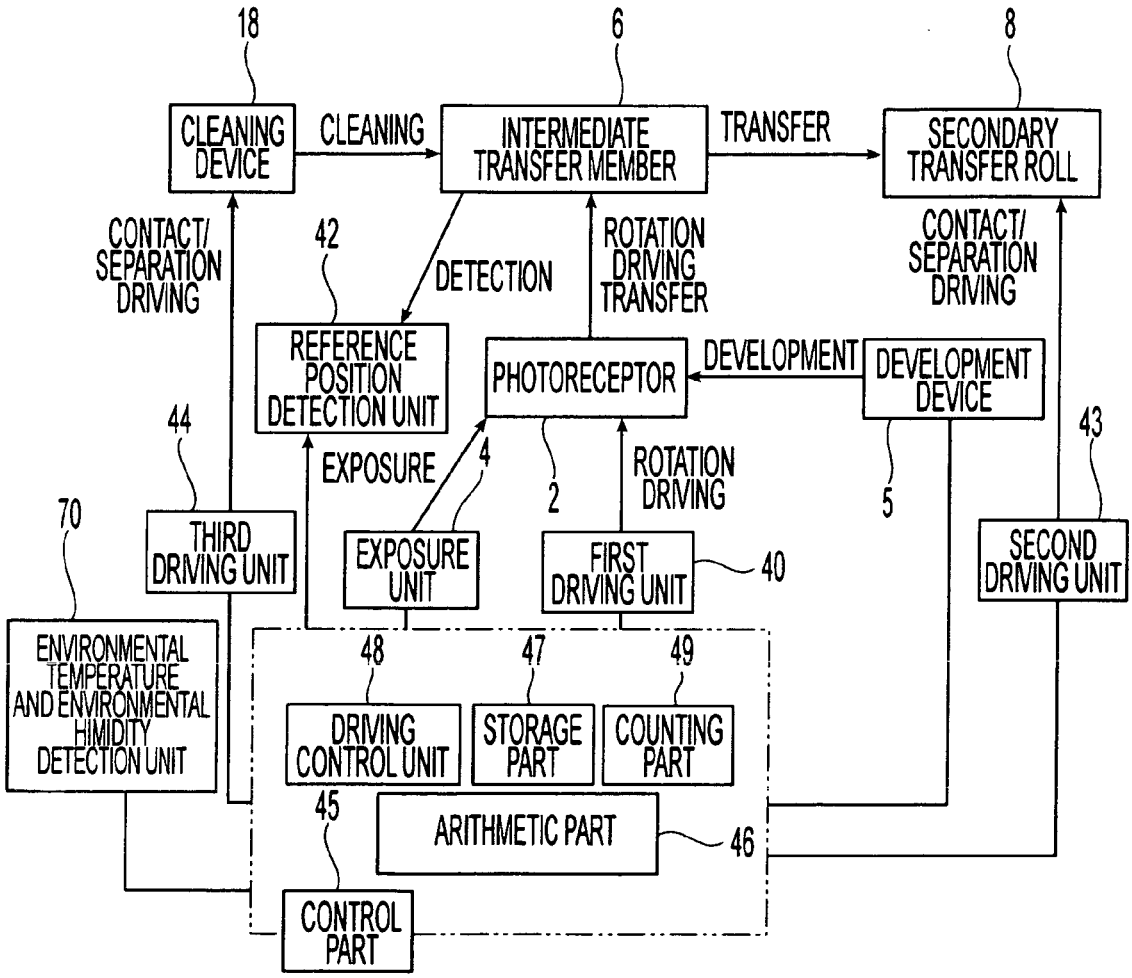
FIG. 14 is a block diagram showing a control part of a full color printer as an image forming apparatus of embodiment 4 of this invention.

FIG. 14 shows embodiment 4 of this invention, and the same portions as those of the embodiment 1 are denoted by the same reference numerals in the following description. This embodiment 4 includes an environmental temperature and environmental humidity detection and unit 70 and an environmental condition storage unit 47 for detecting and storing the environmental temperature and/or environmental humidity in which an image forming apparatus is installed, and when the driving speed of the photoreceptor 2 is increased/decreased, an increase/decrease value at the time when the driving speed of the photoreceptor 2 is increased/decreased is corrected on the basis of the environmental information stored in the environmental condition storage unit 47.

That is, in this embodiment 4, as shown in FIG. 14, an environmental temperature and environmental humidity detection unit 70 for detecting the environmental temperature and/or environmental humidity in which a printer is installed is provided in the inside of the printer, and the detection result of the environmental temperature and environmental humidity detection unit 70 are stored in a storage part 47 as an environmental condition storage unit 47.

With respect to the intermediate transfer belt 6, it is naturally expected that its physical properties, for example, its size at the time of no load, and its elastic coefficient are changed due to the change of the environmental temperature or humidity. The change of the physical properties due to the change of the environmental temperature or humidity is previously grasped by experiment and measurement, and the driving speed of the photoreceptor 2 is corrected on the basis of the result and the environmental information stored in the environmental condition storage unit 47 for the intermediate transfer belt 6 and/or the photoreceptor 2, so that the image superimposition shift correction on the intermediate transfer belt 6 can be performed with high accuracy.

Since the other structure and operation are the same as those of the embodiment 1, their description will be omitted.

Embodiment 5

Figure 15:
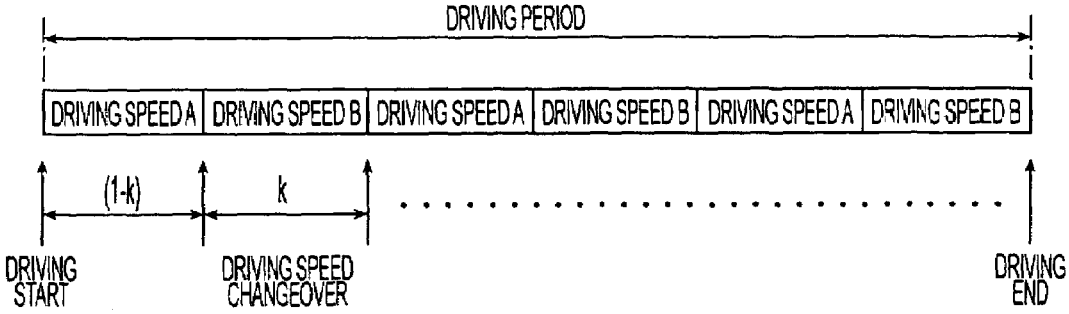
FIG. 15 is an explanatory view showing an operation of a full color printer as an image forming apparatus of embodiment 5 of this invention.

FIG. 15 shows embodiment 5 of this invention, and a description will be given while the same portions as those of the embodiment 1 are denoted by the same reference numerals. In this embodiment 5, the number of kinds of driving speed of a photoreceptor 2 included in a driving unit 40 is set to be smaller than the number of kinds of driving speed of the photoreceptor 2 controlled by the speed control unit.

That is, in this invention, since the degree of elastic deformation of the intermediate transfer member 6 is continuously changed without going through stages according to a load state, it is desirable that changeover of the driving speed of the photoreceptor 2 as the correction unit for an image superimposition shift can also be continuously performed without going through stages. However, there is a limit from restrictions on the cost required for realization.

In this embodiment, as shown in FIG. 15, in the case where an intermediate speed C between two kinds of speeds A and B of the driving speed of the photoreceptor 2 is required, it can be realized by performing a control to change over the speed between A and B at a duty ratio of 50%:

$$C=A\times 0.5+B\times 0.5.$$

Also with respect to a speed other than this, a speed between the driving speeds A and B of the photoreceptor 2 can be realized almost continuously by suitably setting duty ratios Da and Db as set forth below:

$$C=A\times Da+B\times Db.$$

Since the other structure and operation are the same as those of the embodiment 1, their description will be omitted.

Embodiment 6

Figure 16:
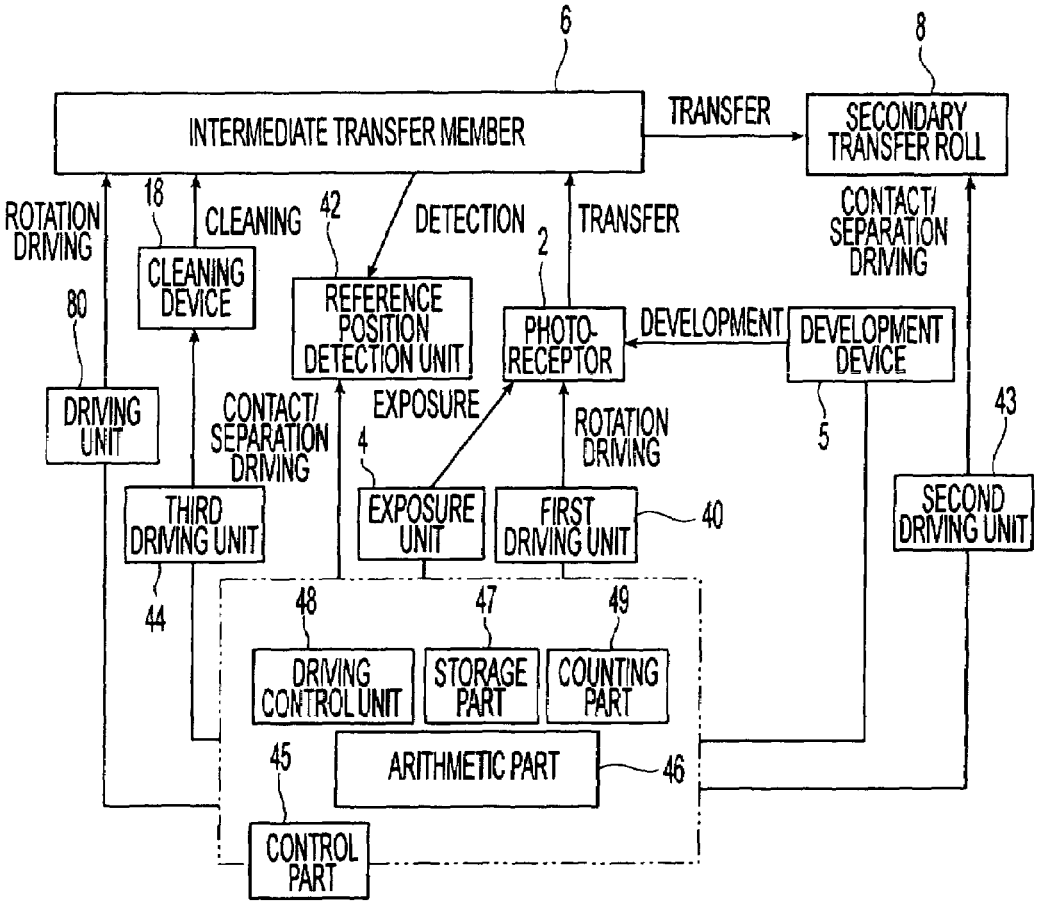
FIG. 16 is a block diagram showing a control part of a full color printer as an image forming apparatus of embodiment 6 of this invention.

FIG. 16 shows embodiment 6 of this invention, and a description will be given while the same portions as those of the embodiment 1 are denoted by the same reference numerals. According to this embodiment 6, an image forming apparatus includes a photoreceptor 2, a photoreceptor driving unit 40 which rotation-drives the photoreceptor 2, an exposure unit 4 which forms a latent image by performing image exposure to the photoreceptor 2, plural development units 5Y, 5M, 5C and 5K which develop plural latent images sequentially formed on the photoreceptor 2 with different color toners respectively, a belt-like intermediate transfer member 6 onto which respective color toner images sequentially developed on the photoreceptor 2 are primarily transferred to be superimposed on each other, an intermediate transfer member driving unit 80 for circulation-driving the belt-like intermediate transfer member 6, and at least one load unit which comes in contact with or is separated from the belt-like intermediate transfer member 6 to change a load on the belt-like intermediate transfer member 6, in which an elastic belt is used as the belt-like intermediate transfer member 6, and a speed control unit which increases/decreases a driving speed of the belt-like intermediate transfer member 6 at a specified timing is provided.

That is, in this embodiment 6, as shown in FIG. 16, the intermediate transfer member 6 does not follow the photoreceptor 2, but is rotation (circulation) driven by a drive motor as an independent intermediate transfer member driving unit 80. As a result, in this embodiment 6, the driving speed of the photoreceptor 2 is not controlled in accordance with the expansion and contraction of the intermediate transfer member 6, but the driving speed of the intermediate transfer member 6 itself is controlled in accordance with the expansion and contraction of the intermediate transfer member 6.

Although the control of the driving speed of the intermediate transfer member 6 is basically based on the same idea as the control of the driving speed of the photoreceptor 2 in the embodiment 1, there is a case where it is slightly different according to the arrangement of a drive roll for driving the intermediate transfer member 6. Among plural rolls for stretching the intermediate transfer member 6, for example, a first cleaning backup roll or stretch roll 19 is rotation driven by the driving unit 80.

A further description will be made. When a cleaning device 18 comes in contact with the surface of the intermediate transfer member 6, since the load is increased, the intermediate transfer member 6 is expanded. Then, the driving speed of the intermediate transfer member 6 is increased, so that the shift of images due to the expansion of the intermediate transfer member 6 can be prevented.

When the secondary transfer roll 8 positioned at a near location on the downstream side comes in contact with the surface of the intermediate transfer member 6, the intermediate transfer member 6 is put in a state where a brake is applied, and is therefore contracted. Then, the driving speed of the intermediate transfer member 6 is decreased, so that it becomes possible to prevent the shift of images due to the contraction of the intermediate transfer member 6.

Since the other structure and operation are the same as those of the embodiment 1, their description will be omitted.

Embodiment 7

Figure 17:
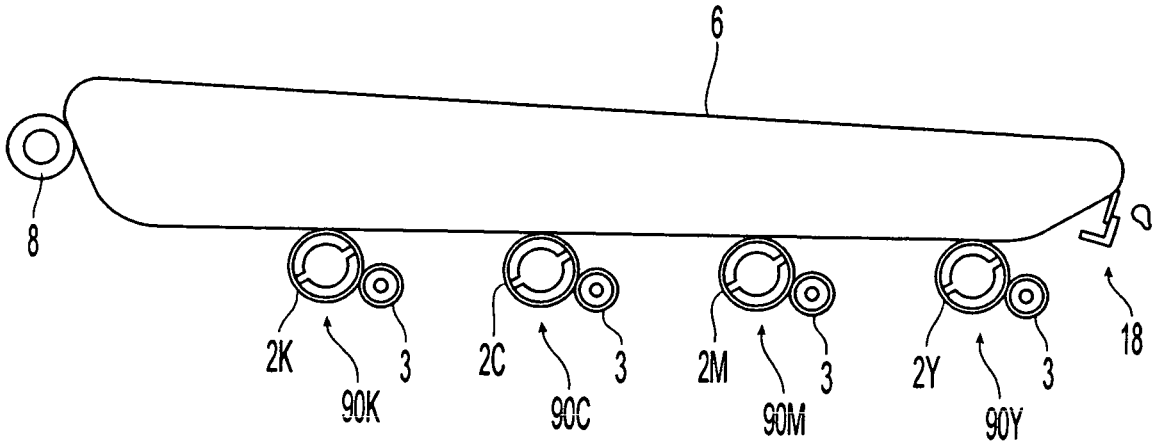
FIG. 17 is a block diagram showing a control part of a full color printer as an image forming apparatus of embodiment 7 of this invention.

FIG. 17 shows embodiment 7 of this invention, and a description will be given while the same portions as those of the embodiment 1 are denoted by the same reference numerals. According to this embodiment 7, an image forming apparatus includes plural photoreceptors 2Y, 2M, 2C and 2K, a driving unit which rotation-drives the plural photoreceptors 2Y, 2M, 2C and 2K, an exposure unit 4 which forms latent images by performing image exposure to the plural photoreceptors 2Y, 2M, 2C and 2K, plural development units 5Y, 5M, 5C and 5K which develop plural latent images sequentially formed on the plural photoreceptors 2Y, 2M, 2C and 2K with different color toners respectively, a belt-like intermediate transfer member 6 which follows the photoreceptors 2Y, 2M, 2C and 2K and is driven thereby and onto which respective color toner images sequentially developed on the plural photoreceptors 2Y, 2M, 2C and 2K are primarily transferred to be superimposed on each other, and at least one load unit which comes in contact with or is separated from the belt-like intermediate transfer member 6 to change a load on the belt-like intermediate transfer member 6, in which an elastic belt is used as the belt-like intermediate transfer member 6, and a speed control unit which increases/decreases a driving speed of the photoreceptors 2Y, 2M, 2C and 2K in a period from start of latent image formation of at least one color to completion of transfer at a specified timing is provided.

That is, in this embodiment 7, as shown in FIG. 17, the full color printer is constructed to adopt the so-called tandem system, not the four-cycle system, and image formation parts 90Y, 90M, 90C and 90K of the respective colors of yellow (Y), magenta (M), cyan (C) and black (K) are disposed under an intermediate transfer belt 6. A photosensitive drum 2, a charging roll 3, a not-shown image exposure part and development device are provided in each of the image formation parts 90Y, 90M, 90C and 90K of the respective colors.

Besides, the intermediate transfer belt 6 is stretched by plural rolls, and a secondary transfer roll 8 and a cleaning device 18 come in contact with or are separated from the surface of the intermediate transfer belt 6.

Since the other structure and operation are the same as those of the embodiment 1, their description will be omitted.

The invention of aspect 2 is the image forming apparatus characterized in that in the image forming apparatus of aspect 1, the belt-like intermediate transfer member follows the photoreceptor and is driven by the photoreceptor.

The invention of aspect 3 is the image forming apparatus characterized in that in the image forming apparatus of aspect 1, the speed control unit makes a photoreceptor driving speed in a part of or the whole of a period when a latent image of at least one color is formed different from a photoreceptor driving speed in latent image formation of another color.

In this invention of aspect 3, similarly to the invention of aspect 1, since the elastic belt is used as the belt-like intermediate transfer member, elastic deformation occurs in the belt-like intermediate transfer member when the load unit comes in contact with or is separated from the belt-like intermediate transfer member, and a shift occurs between images transferred on the belt-like intermediate transfer member. Then, the photoreceptor driving speed in the part of or the whole of the period when the latent image of at least one color is formed is made different from the photoreceptor driving speed in the latent image formation of another color by the speed control unit, so that it becomes possible to correct the influence of the elastic deformation occurring in the belt-like intermediate transfer member due to the contact or separation of the load unit.

The invention of aspect 4 is the image forming apparatus characterized in that in the image forming apparatus of aspect 1, during a period from start of latent image formation of a first color to completion of transfer of the first color, the speed control unit increases/decreases the driving speed of the photoreceptor in response to a timing when the load unit in contact with the belt-like intermediate transfer belt is separated therefrom.

Here, the expression of "in response to" the timing when the load unit is separated has such a meaning that according to the timing when the load unit is separated, and means that the increase/decrease of the driving speed of the photoreceptor may not be always performed at the same time as the timing when the load unit is separated, and it has only to be performed in a specific relation to the timing when the load unit is separated. The expression of "increases/decreases" the driving speed of the photoreceptor literally means to increase or decrease the driving speed of the photoreceptor, and whether the driving speed of the photoreceptor is increased or decreased is decided on the basis of the expansion and contraction of the belt-like intermediate transfer member made of the elastic belt.

The invention of aspect 5 is the image forming apparatus characterized in that in the image forming apparatus of aspect 1, during a period from start of latent image formation of a final color to completion of transfer of the final color, the speed control unit increases/decreases the driving speed of the photoreceptor in response to a timing when the load unit separate from the belt-like intermediate transfer member comes in contact therewith.

The invention of aspect 6 is the image forming apparatus characterized in that in the image forming apparatus of aspect 1, further includes a cleaning unit which is constructed to come in contact with or to be separated from the belt-like intermediate transfer member by a second driving unit and cleans a surface of the belt-like intermediate transfer member, a secondary transfer unit which is constructed to come in contact with or to be separated from the belt-like intermediate transfer member by a third driving unit and secondarily transfers the plural color toner images superimposed on the belt-like intermediate transfer belt onto a recording medium at once, and a speed control unit which increases/decreases a driving speed of the photoreceptor in response to a timing when the cleaning unit is separated from the belt-like intermediate transfer member.

The invention of aspect 7 is the image forming apparatus characterized in that in the image forming apparatus of aspect 6, the speed control unit increases/decreases the driving speed of the photoreceptor in response to a timing when the cleaning unit comes in contact with the belt-like intermediate transfer member.

The invention of aspect 8 is the image forming apparatus characterized in that in the image forming apparatus of aspect 6, the speed control unit increases/decreases the driving speed of the photoreceptor in response to a timing when the secondary transfer unit is separated from the belt-like intermediate transfer member.

The invention of aspect 9 is the image forming apparatus characterized in that in the image forming apparatus of aspect 6, the speed control unit increases/decreases the driving speed of the photoreceptor in response to a timing when the secondary transfer unit comes in contact with the belt-like intermediate transfer member.

The invention of aspect 10 is the image forming apparatus characterized in that the image forming apparatus of aspect 1 further includes a speed control unit which decreases or increases a driving speed of the photoreceptor in response to a timing when the load unit comes in contact with the belt-like intermediate transfer member in a case where the load unit is disposed at a position close to a downstream side of the photoreceptor with respect to a distance on a periphery of the belt-like intermediate transfer member.

The invention of aspect 11 is the image forming apparatus characterized in that in the image forming apparatus of aspect 10, the speed control unit increases or decreases the driving speed of the photoreceptor in response to a timing when the load unit is separated from the belt-like intermediate transfer member in the case where the load unit is disposed at the position close to the downstream side of the photoreceptor with respect to the distance on the periphery of the belt-like intermediate transfer member.

The invention of aspect 12 is the image forming apparatus characterized in that the image forming apparatus of aspect 1 further includes a speed control unit which increases or decreases a driving speed of the photoreceptor in response to a timing when the load unit comes in contact with the belt-like intermediate transfer member in a case where the load unit is disposed at a position close to an upstream side of the photoreceptor with respect to a distance on a periphery of the belt-like intermediate transfer member.

The invention of aspect 13 is the image forming apparatus characterized in that in the image forming apparatus of aspect 12, the speed control unit decreases or increases the driving speed of the photoreceptor in response to a timing when the load unit is separated from the belt-like intermediate transfer member in the case where the load unit is disposed at the position close to the upstream side of the photoreceptor with respect to the distance on the periphery of the belt-like intermediate transfer member.

The invention of aspect 14 is the image forming apparatus characterized in that the image forming apparatus of aspect 1 further includes a speed control unit which increases/decreases a driving speed of the photoreceptor in a period from start of latent image formation of at least one color to completion of transfer at a specified timing.

The invention of aspect 15 is the image forming apparatus characterized in that in the image forming apparatus of aspect 14, the speed control unit makes a photoreceptor driving speed in a part of or the whole of a period of latent image formation of at least one photoreceptor different from a photoreceptor driving speed in latent image formation of another color.

The invention of aspect 16 is the image forming apparatus characterized in that the image forming apparatus of aspect 1 further includes an expansion and contraction detection unit which detects expansion and contraction of the belt-like intermediate transfer member, and a speed at a time when the driving speed of the photoreceptor is increased/decreased is decided on the basis of a detection result of the expansion and contraction detection unit.

In the invention, the superimposition shift on the belt-like intermediate transfer member in the respective color developments is due to the difference in the degree of elastic deformation occurring in the belt-like intermediate transfer member, and when the degree of elastic deformation is detected by the expansion and contraction detection unit, and the photoreceptor is driven on the basis of the result, the superimposition shift can be corrected with higher accuracy. As the expansion and contraction detection unit, various units, such as a unit which detects a load applied to the intermediate transfer belt, a unit which directly detects the distortion of the intermediate transfer member, or a unit which measures a time required for one rotation of the intermediate transfer member, can be used.

The invention of aspect 17 is the image forming apparatus characterized in that in the image forming apparatus of aspect 16, an operation of detecting the expansion and contraction of the belt-like intermediate transfer member by the expansion and contraction detection unit is performed at a time of a process control operation.

In this invention, the operation of detecting the expansion and contraction of the belt-like intermediate transfer member is performed at the time of the process control operation, so that lowering of output speed of the image forming apparatus can be reduced.

The invention of aspect 18 is the image forming apparatus characterized in that in the image forming apparatus of aspect 16, the decided driving speed of the photoreceptor is stored in a storage unit and is again used until it is updated next time.

In the case where only improvement of accuracy of the superimposition shift correction of images on the intermediate transfer member is considered, it is desirable that the detection of the expansion and contraction of the intermediate transfer member and the decision of the photoreceptor driving speed to correct this are performed each time. However, this reduces the output speed of the image forming apparatus. In order to prevent this, it is desirable that the driving speed of the photoreceptor once decided is stored in the storage unit, and is again used until a next update time when it is expected that the detection of the expansion and contraction of the intermediate transfer belt and the change of the photoreceptor driving speed are again required due to aging, the change of the environment, and the number of output sheets after the change of the photoreceptor driving speed.

The invention of aspect 19 is the image forming apparatus characterized in that the image forming apparatus of aspect 16 further includes a counting and storage unit for counting and storing a life of the photoreceptor and/or the belt-like intermediate transfer member, and when the driving speed of the photoreceptor is increased or decreased, an increase/decrease value at the time when the driving speed of the photoreceptor is increased/decreased is corrected on the basis of life information stored in the counting and storage unit.

With respect to the belt-like intermediate transfer member, it is naturally expected that its physical property values, for example, its size at the time of no load, and its elastic coefficient are changed due to aging till the end of the life. The changes of the physical property values with the passage of time are previously grasped by experiment and measurement, and the driving speed of the photoreceptor is corrected on the basis of the result and the life information stored in the lift counting and storage unit for the intermediate transfer member and/or a photoreceptor, so that the shift correction of image superimposition on the intermediate transfer member can be performed with high accuracy.

The invention of aspect 20 is the image forming apparatus characterized in that the image forming apparatus of aspect 16 further includes an environmental condition detection and storage unit which detects and stores environmental temperature and/or environmental humidity in which the image forming apparatus is installed, and when the driving speed of the photoreceptor is increased/decreased, an increase/decrease value at the time when the driving speed of the photoreceptor is increased/decreased is corrected on the basis of environmental information stored in the environmental condition detection and storage unit.

With respect to the intermediate transfer belt, it is naturally expected that its physical property values, for example, its size at the time of no load, and its elastic coefficient are changed by the change of the environmental temperature and humidity. The change of the physical property values due to the change of the environmental temperature and humidity are previously grasped by the experiment and measurement, and the driving speed of the photoreceptor is corrected on the basis of the result and the environmental information stored in the environmental condition detection storage unit for the intermediate transfer belt and/or a photoreceptor, so that the shift correction of image superimposition on the intermediate transfer medium can be performed with high accuracy.

The invention of aspect 21 is the image forming apparatus characterized in that in the image forming apparatus of aspect 16, the expansion and contraction detection unit includes at least one reference position detection mark provided on the belt-like intermediate transfer member, a reference position detection unit which detects the reference position detection mark, and a counter for measuring a period of the reference position detection mark detected by the reference position detection unit.

Since the expansion and contraction detection unit is used which is constructed of at least the one reference position detection mark provided on the belt-like intermediate transfer member, the reference position detection unit which detects the reference position detection mark, and the counter which measures the period of the reference position detection mark detected by the reference position detection unit, the expansion and contraction detection unit for the intermediate transfer belt can be realized inexpensively, with high accuracy and with high reliability.

The invention of aspect 22 is the image forming apparatus characterized in that in the image forming apparatus of aspect 21, the reference position detection mark is an image developed by the development unit and transferred onto the belt-like intermediate transfer member.

The invention of aspect 23 is the image forming apparatus characterized in that in the image forming apparatus of aspect 21, a time measurable by the counter is set to be shorter than the detected period of the belt-like intermediate transfer member under measurement. In this case, the measurable time of the counter may be short, and an inexpensive counter can be adopted. Further, the improvement in accuracy becomes possible by using the counter which can detect the total detection period of the belt-like intermediate transfer member.

The invention of aspect 24 is the image forming apparatus characterized in that the image forming apparatus of aspect 1 further includes an intermediate transfer member driving unit for circulation-driving the belt-like intermediate transfer member, and a speed control unit which increases/decreases a driving speed of the belt-like intermediate transfer member at a specified timing.

The invention of aspect 25 is the image forming apparatus characterized in that in the image forming apparatus of aspect 1, the number of kinds of driving speed of the photoreceptor included in the driving unit is set to be smaller than the number of kinds of driving speed of the photoreceptor controlled by the speed control unit.

The invention of aspect 26 is the image forming apparatus characterized in that in the image forming apparatus of aspect 16, a lead registration correction value of an image formed on the photoreceptor is decided on the basis of the detection result of the expansion and contraction detection unit.

The invention of aspect 27 is the image forming apparatus characterized in that the image forming apparatus of aspect 1 further includes an intermediate transfer member driving unit which circulation-drives the belt-like intermediate transfer member, a cleaning unit which is constructed to come in contact with or to be separated from the belt-like intermediate transfer member by a second driving unit and cleans a surface of the belt-like intermediate transfer member, a secondary transfer unit which is constructed to come in contact with or to be separated from the belt-like intermediate transfer member by a third driving unit and secondarily transfers plural color toner images superimposed on the belt-like intermediate transfer member onto a recording medium at once, and a speed control unit which increases/decreases a driving speed of the belt-like intermediate transfer member in response to a timing when the cleaning unit is separated from the belt-like intermediate transfer member.

The invention of aspect 28 is the image forming apparatus characterized in that the image forming apparatus of aspect 1 further includes an intermediate transfer member driving unit which circulation-drives the belt-like intermediate transfer member, and a speed control unit which decreases or increases a driving speed of the belt-like intermediate transfer member in response to a timing when the load unit comes in contact with the belt-like intermediate transfer member in a case where the load unit is disposed at a position close to a downstream side of the photoreceptor with respect to a distance on a periphery of the belt-like intermediate transfer member.

The invention of aspect 29 is the image forming apparatus characterized in that the image forming apparatus of aspect 1 further includes an intermediate transfer member driving unit which circulation-drives the belt-like intermediate transfer member, and a speed control unit which increases or decreases a driving speed of the belt-like intermediate transfer member in response to a timing when the load unit comes in contact with the belt-like intermediate transfer member in a case where the load unit is disposed at a position close to an upstream side of the photoreceptor with respect to a distance on a periphery of the belt-like intermediate transfer member.

The invention of aspect 30 is the image forming apparatus characterized in that the image forming apparatus of aspect 1 further includes an intermediate transfer member driving unit which circulation-drives the belt-like intermediate transfer member, and a speed control unit which increases/decreases a driving speed of the belt-like intermediate transfer member in a period from start of latent image formation of at least one color to completion of transfer at a specified timing.

In this invention, since the degree of elastic deformation of the intermediate transfer member is continuously changed by the load state without going through stages, it is desirable that changeover of the photoreceptor driving speed as the correction unit of the image superimposition shift can be continuously performed without going through stages. However, there is a limitation from the cost required for realization. Then, in the case where an intermediate speed C between two kinds of photoreceptor driving speeds A and B is required, it can be realized by changing and controlling both the speeds A and B at a duty ratio of 50%:

$$C=A\times 0.5+B\times 0.5.$$

Incidentally, also with respect to a speed other than this, by suitably setting duty ratios Da and Db set forth below, a speed between the photoreceptor driving speeds A and B can be substantially continuously realized:

$$C=A\times Da+B\times Db.$$

EFFECTS OF THE INVENTION

According to this invention, it is possible to provide the image forming apparatus in which even in the case where the contact/separation operation of the cleaning device or the secondary transfer member to the surface of the intermediate transfer member occurs during the image formation operation, the occurrence of the color shift can be suppressed, and a high quality image can be formed without lowering productivity.

The entire disclosure of Japanese Patent Application No. 2003-435675 filed on Dec. 26, 2003 including specification, claims, drawings and abstract is incorporated herein by reference in its entirety.

What is claimed is:

1. An image forming apparatus comprising:

a photoreceptor;

a driving unit which rotation-drives the photoreceptor;

an exposure unit which forms a latent image by performing image exposure to the photoreceptor;

a plurality of development units which develop a plurality of latent images sequentially formed on the photoreceptor with different color toners respectively;

a belt-like intermediate transfer member onto which respective color toner images sequentially developed on the photoreceptor are primarily transferred to be superimposed on each other;

at least one load unit which comes in contact with or is separated from the belt-like intermediate transfer member to change a load on the belt-like intermediate transfer member; and a speed control unit which increases/decreases a driving speed of the photoreceptor at a specified timing, wherein the belt-like intermediate transfer member is an elastic belt.

2. The image forming apparatus according to claim 1, wherein the belt-like intermediate transfer member follows the photoreceptor and is driven by the photoreceptor.

3. The image forming apparatus according to claim 1, wherein the speed control unit makes a photoreceptor driving speed in a part of or the whole of a period when a latent image of at least one color is formed different from a photoreceptor driving speed in latent image formation of another color.

4. The image forming apparatus according to claim 1, wherein during a period from start of latent image formation of a first color to completion of transfer of the first color, the speed control unit increases/decreases the driving speed of the photoreceptor in response to a timing when the load unit in contact with the belt-like intermediate transfer member is separated therefrom.

5. The image forming apparatus according to claim 1, wherein during a period from start of latent image formation of a final color to completion of transfer of the final color, the speed control unit increases/decreases the driving speed of the photoreceptor in response to a timing when the load unit separate from the belt-like intermediate transfer member comes in contact therewith.

6. The image forming apparatus according to claim 1, further comprising:

a cleaning unit which is constructed to come in contact with or to be separated from the belt-like intermediate transfer member by a second driving unit and cleans a surface of the belt-like intermediate transfer member;

a secondary transfer unit which is constructed to come in contact with or to be separated from the belt-like intermediate transfer member by a third driving unit and secondarily transfers the plurality of color toner images superimposed on the belt-like intermediate transfer member onto a recording medium at once; and a speed control unit which increases/decreases a driving speed of the photoreceptor in response to a timing when the cleaning unit is separated from the belt-like intermediate transfer member.

7. The image forming apparatus according to claim 6, wherein the speed control unit increases/decreases the driving speed of the photoreceptor in response to a timing when the cleaning unit comes in contact with the belt-like intermediate transfer member.

8. The image forming apparatus according to claim 6, wherein the speed control unit increases/decreases the driving speed of the photoreceptor in response to a timing when the secondary transfer unit is separated from the belt-like intermediate transfer member.

9. The image forming apparatus according to claim 6, wherein the speed control unit increases/decreases the driving speed of the photoreceptor in response to a timing when the secondary transfer unit comes in contact with the belt-like intermediate transfer member.

10. The image forming apparatus according to claim 1, further comprising:

a speed control unit which decreases or increases a driving speed of the photoreceptor in response to a timing when the load unit comes in contact with the belt-like intermediate transfer member in a case where the load unit is disposed at a position close to a downstream side of the photoreceptor with respect to a distance on a periphery of the belt-like intermediate transfer member.

11. The image forming apparatus according to claim 10, wherein the speed control unit increases or decreases the driving speed of the photoreceptor in response to a timing when the load unit is separated from the belt-like intermediate transfer member in the case where the load unit is disposed at the position close to the downstream side of the photoreceptor with respect to the distance on the periphery of the belt-like intermediate transfer member.

12. The image forming apparatus according to claim 1, further comprising:

a speed control unit which increases or decreases a driving speed of the photoreceptor in response to a timing when the load unit comes in contact with the belt-like intermediate transfer member in a case where the load unit is disposed at a position close to an upstream side of the photoreceptor with respect to a distance on a periphery of the belt-like intermediate transfer member.

13. The image forming apparatus according to claim 12, wherein the speed control unit decreases or increases the driving speed of the photoreceptor in response to a timing when the load unit is separated from the belt-like intermediate transfer member in the case where the load unit is disposed at the position close to the upstream side of the photoreceptor with respect to the distance on the periphery of the belt-like intermediate transfer member.

14. The image forming apparatus according to claim 1, further comprising:

a speed control unit which increases/decreases a driving speed of the photoreceptor in a period from start of latent image formation of at least one color to completion of transfer at a specified timing.

15. The image forming apparatus according to claim 14, wherein the speed control unit makes a photoreceptor driving speed in a part of or the whole of a period of latent image formation of at least one photoreceptor different from a photoreceptor driving speed in latent image formation of another color.

16. The image forming apparatus according to claim 1, further comprising:

an expansion and contraction detection unit which detects expansion and contraction of the belt-like intermediate transfer member, wherein a speed at a time when the driving speed of the photoreceptor is increased/decreased is decided on the basis of a detection result of the expansion and contraction detection unit.

17. The image forming apparatus according to claim 16, wherein an operation of detecting the expansion and contraction of the belt-like intermediate transfer member by the expansion and contraction detection unit is performed at a time of a process control operation.

18. The image forming apparatus according to claim 16, wherein the decided driving speed of the photoreceptor is stored in a storage unit and is again used until it is updated next time.

19. The image forming apparatus according to claim 16, further comprising:

a counting and storage unit which counts and stores a life of the photoreceptor and/or the belt-like intermediate transfer member, wherein when the driving speed of the photoreceptor is increased or decreased, an increase/decrease value of the driving speed of the photoreceptor is corrected on the basis of life information stored in the counting and storage unit.

20. The image forming apparatus according to claim 16, further comprising:

an environmental condition detection and storage unit which detects and stores environmental temperature and/or environmental humidity in which the image forming apparatus is installed, wherein when the driving speed of the photoreceptor is increased/decreased, an increase/decrease value of the driving speed of the photoreceptor is corrected on the basis of environmental information stored in the environmental condition detection and storage unit.

21. The image forming apparatus according to claim 16, wherein the expansion and contraction detection unit includes:

at least one reference position detection mark provided on the belt-like intermediate transfer member;

a reference position detection unit which detects the reference position detection mark; and a counter for measuring a period of the reference position detection mark detected by the reference position detection unit.

22. The image forming apparatus according to claim 21, wherein the reference position detection mark is an image developed by one of the development units and transferred on the belt-like intermediate transfer member.

23. The image forming apparatus according to claim 21, wherein a time measurable by the counter is set to be shorter than the detected period of the belt-like intermediate transfer member under measurement.

24. The image forming apparatus according to claim 1, further comprising:

an intermediate transfer member driving unit which circulation-drives the belt-like intermediate transfer member; and a speed control unit which increases/decreases a driving speed of the belt-like intermediate transfer member at a specified timing.

25. The image forming apparatus according to claim 1, wherein the number of kinds of driving speed of the photoreceptor included in the driving unit is set to be smaller than the number of kinds of driving speed of the photoreceptor controlled by the speed control unit.

26. The image forming apparatus according to claim 16, wherein a lead registration correction value of an image formed on the photoreceptor is decided on the basis of the detection result of the expansion and contraction detection unit.

27. The image forming apparatus according to claim 1, further comprising:

an intermediate transfer member driving unit which circulation-drives the belt-like intermediate transfer member;

a cleaning unit which is constructed to come in contact with or to be separated from the belt-like intermediate transfer member by a second driving unit and cleans a surface of the belt-like intermediate transfer member; and a secondary transfer unit which is constructed to come in contact with or to be separated from the belt-like intermediate transfer member by a third driving unit and secondarily transfers the plurality of color toner images superimposed on the belt-like intermediate transfer member onto a recording medium at once, a speed control unit which increases/decreases a driving speed of the belt-like intermediate transfer member in response to a timing when the cleaning unit is separated from the belt-like intermediate transfer member.

28. The image forming apparatus according to claim 1, further comprising:

an intermediate transfer member driving unit which circulation-drives the belt-like intermediate transfer member; and a speed control unit which decreases or increases a driving speed of the belt-like intermediate transfer member in response to a timing when the load unit comes in contact with the belt-like intermediate transfer member in a case where the load unit is disposed at a position close to a downstream side of the photoreceptor with respect to a distance on a periphery of the belt-like intermediate transfer member.

29. The image forming apparatus according to claim 1, further comprising:

an intermediate transfer member driving unit which circulation-drives the belt-like intermediate transfer member; and a speed control unit which increases or decreases a driving speed of the belt-like intermediate transfer member in response to a timing when the load unit comes in contact with the belt-like intermediate transfer member in a case where the load unit is disposed at a position close to an upstream side of the photoreceptor with respect to a distance on a periphery of the belt-like intermediate transfer member.

30. The image forming apparatus according to claim 1, further comprising:

an intermediate transfer member driving unit which circulation-drives the belt-like intermediate transfer member; and a speed control unit which increases/decreases a driving speed of the belt-like intermediate transfer member in a period from start of latent image formation of at least one color to completion of transfer at a specified timing.

31. The image forming apparatus according to claim 1, wherein an intermediate driving speed of photoreceptor between two kinds of driving speeds of photoreceptor is realized by changing and controlling the speeds at a duty ratio of 50%.

32. The image forming apparatus according to claim 1, wherein any driving speed of photoreceptor between two kinds of driving speeds of photoreceptor is realized by suitably setting a duty ratio, and changing and controlling the speeds at the duty ratio.

33. The image forming apparatus according to claim 1, wherein the elastic belt is made of rubber material in which Young's modulus is in a range of 1.5–30 MPa.

34. The image forming apparatus according to claim 1, wherein the elastic belt is made of chloroprene rubber in which Young's modulus is in a range of 5–15 MPa.

35. The image forming apparatus according to claim 1, wherein the elastic belt is made of urethane rubber in which Young's modulus is in a range of 5–30 MPa.

36. The image forming apparatus according to claim 1, wherein the elastic belt is made of silicone rubber in which Young's modulus is in a range of 1.5–5 MPa.

* * * * *